United States Patent [19]

Fujio

[11] Patent Number: 4,958,993

[45] Date of Patent: Sep. 25, 1990

[54] SCROLL COMPRESSOR WITH THRUST SUPPORT MEANS

[75] Inventor: Katuharu Fujio, Kouga, Japan

[73] Assignee: Matsushita Electric Industrial Co., Ltd., Kadoma, Japan

[21] Appl. No.: 291,233

[22] Filed: Dec. 28, 1988

[30] Foreign Application Priority Data

| | | | |
|---|---|---|---|
| Dec. 28, 1987 | [JP] | Japan | 62-332005 |
| Jun. 28, 1988 | [JP] | Japan | 63-159990 |
| Jun. 28, 1988 | [JP] | Japan | 63-159996 |

[51] Int. Cl.[5] ..... F04C 18/04; F04C 29/02

[52] U.S. Cl. ..... 418/55.3; 418/55.4; 418/55.5; 418/55.6; 418/57; 418/88; 418/97

[58] Field of Search ..... 418/55 R, 55 B, 55 C, 418/55 D, 55 E, 57, 88, 97

[56] References Cited

U.S. PATENT DOCUMENTS

| | | | |
|---|---|---|---|
| 1,967,957 | 7/1934 | Lucas . | |
| 2,841,089 | 7/1958 | Jones . | |
| 3,600,114 | 8/1971 | Dvoraki | 418/57 |
| 3,817,664 | 6/1974 | Bennett et al. | 418/57 |
| 3,874,827 | 1/1975 | Young | 418/57 |
| 3,924,977 | 12/1975 | McCullough | 418/57 |
| 3,986,799 | 10/1976 | McCullough | 418/55 D |
| 3,994,633 | 11/1976 | Shaffer | 418/5 |
| 4,065,279 | 12/1977 | McCullough | 418/55 D |
| 4,121,438 | 10/1978 | McCullough | 64/31 |
| 4,350,479 | 9/1982 | Tojo et al. | 418/57 |
| 4,365,941 | 12/1982 | Tojo et al. | 418/57 |
| 4,384,831 | 5/1983 | Ikegawa et al. | 418/57 |
| 4,552,518 | 11/1985 | Utter | 418/97 |
| 4,557,675 | 12/1985 | Murayama et al. | 418/57 |
| 4,579,512 | 4/1986 | Shiibayashi et al. | 418/178 |
| 4,600,369 | 7/1986 | Blain | 418/57 |
| 4,645,437 | 2/1987 | Sakashita et al. | 418/57 |
| 4,648,814 | 3/1987 | Shiibayashi | 418/97 |
| 4,674,963 | 6/1987 | Morishita et al. | 418/83 |

FOREIGN PATENT DOCUMENTS

| | | | |
|---|---|---|---|
| 3341637 | 6/1984 | Fed. Rep. of Germany . | |
| 3422389 | 12/1984 | Fed. Rep. of Germany . | |
| 3522854 | 1/1986 | Fed. Rep. of Germany . | |
| 2195270 | 1/1974 | France . | |
| 55-142902 | 11/1980 | Japan . | |
| 57-8386 | 1/1982 | Japan . | |
| 58-79684 | 5/1983 | Japan | 418/55 D |
| 59-29790A | 2/1984 | Japan . | |
| 60-249685 | 12/1985 | Japan | 418/55 D |
| 61-8407 | 1/1986 | Japan | 418/55 D |
| 61-223287A | 3/1986 | Japan . | |
| 61-157783A | 7/1986 | Japan . | |
| 2194291 | 3/1988 | United Kingdom . | |

*Primary Examiner*—John J. Vrablik

*Attorney, Agent, or Firm*—Cushman, Darby & Cushman

[57] ABSTRACT

In a scroll compressor, a thrust bearing is movably held and urged to support thrust force of an orbiting scroll member against a fixed scroll member within a predetermined stroke in the axial direction of the scroll members, thereby to always allow desirable minute gap and also allow to move back against the urging force to reduce abnormal pressure in a compression chamber.

13 Claims, 24 Drawing Sheets

SCROLL COMPRESSOR WITH THRUST SUPPORT MEANS

FIELD OF THE INVENTION AND RELATED ART STATEMENT

1. Field of the Invention

The present invention relates to a scroll compressor which is to be used in an air conditioner, a refrigerator or the like.

2. Description of the Related Art

A scroll compressor has been known as the compressor of minimum vibration and low noise. The scroll compressor has several known characteristics. For instance, a suction chamber is disposed outside a body of the compressor, and a discharge port is provided at the center of scroll. Further, compression ratio is kept constant, and flowing direction of compression fluid is uniform toward the discharge port. Therefore, change of torque and pulsation of delivery are comparatively small, and also the vibration is minimized. Besides, delivery space is small, and an outlet valve, which has been hitherto required for the reciprocating compressor or the rotary compressor in order to compress the fluid, is not required. Therefore, the scroll compressor is silently driven. From these excellent performances, development for practical use of the scroll compressor has been made in many technical fields.

However, since there are many sealed portions in a compression chamber, amount of leakage of the compressed fluid is large. In a small displacement scroll compressor such as that of air conditioner for domestic use, very high precision of size is required for the scroll part in order to minimize gaps through which compressed fluid leaks out of the compression chamber. However, dispersion in accuracy of size, which is caused by complicated shapes of parts brings the undesirable state that compression efficiency is lower than that of the reciprocating compressor or the rotary compressor particularly in low running speed, and further price of the scroll compressor becomes high. Besides, it is expected that costs of related parts other than the scroll part is to be reduced.

In order to improve sealing performance, a compressor wherein oil seal effect utilizing a lubricating oil is employed to prevent leakage of compressed gas has been presented. In a compressor disclosed in Japanese unexamined patent publication Sho 57-8386, pressure of the lubricating oil at the bottom of a delivery chamber is reduced, so that the lubricating oil flows therefrom into the compression chamber which is in the compressing state. Precision in size in the scroll part can be thereby made less strict, and besides compression efficiency is improved.

FIG. 21 is a cross-sectional view showing the conventional scroll compressor as disclosed in Japanese unexamined patent publication Sho 55-142902 or U.S. Pat. No. 3,994,633 etc., and FIG. 22 is a partially enlarged view of FIG. 21. This compressor is designed to reduce jumping of an orbiting scroll member at high running speed, thereby to further improve vibration and noise characteristics. In the figure, the orbiting scroll member 1001 is connected to a driving pin 1007*a* of a driving shaft 1007. An end plate 1001*a* of the orbiting scroll member 1001 is held between an end plate 1002*a* of a fixed scroll member 1002 and a frame 1008 with minute gaps formed therebetween. Jumping of the orbiting scroll member 1001 is thereby prevented at the time even when compression load or inertia of moving members changes, namely, at the time of starting, stopping and high speed running of the compressor. Medium pressure fluid, which is in the compression state, is led onto a rear side surface of the orbiting scroll member 1001, thereby urging to push the orbiting scroll member 1001 to the fixed scroll member 1002. Thus, gaps between the orbiting scroll member 1001 and the fixed scroll member 1002 in an axial direction of the compressor are minimized, thereby tightly closing the compression chamber. As a result, compression efficiency is improved, and abnormal noise, which is caused by collision of respective parts with each other, and declination of durability are considerably prevented.

In general, the orbiting scroll member 1001 orbits in accordance with cooperating actions of a crank mechanism of driving shaft and a rotation-prevention mechanism to prohibit the orbiting scroll member from moving angularly with respect to the fixed scroll member. In such orbiting motion, the centrifugal force generated in the orbiting scroll member acts on a bearing of the driving shaft whereto the orbiting scroll member is to be engaged, and a predetermined counterweight is required on the driving shaft. Thereby, the driving parts are dynamically balanced so that vibration on a driving shaft is decreased.

In such a scroll compressor that a compression part is disposed only at one side of the driving shaft, rotation-prevention parts of the orbiting scroll member reciprocates together with the orbiting scroll member. As a result, a center of gravity of orbiting parts (the orbiting scroll member and the rotation-prevention parts) moves in accordance with rotation angle of the driving shaft, and so, a perfect dynamic balancing of the driving parts can not be attained. Therefore, there remains an unsolved problem how to make the rotation-prevention parts light in weight.

Particularly, as to the compressor which improves compression efficiency by driving itself up to high speed, the orbiting scroll member made of such a light specific gravity material as an alloy of aluminum is used in order to lighten the load applied on the bearing of the driving shaft which is to be engaged with the orbiting scroll member. Thus, it is known that to make the rotation-prevention parts light in weight is one of the most important matter to reduce the noise of the scroll compressor.

FIG. 23 is a cross-sectional view showing another conventional scroll compressor disclosed in the U.S. Pat. No. 3,924,977, and FIG. 24 and FIG. 25 are a plane view and a cross-sectional view of the coupling member 3090 in FIG. 23, respectively. These figures are cited to show the conventional rotation-prevention mechanism of the orbiting scroll member. In FIGS. 24 and 25, keyways 3096, 3097, 3098 and 3099 are formed in respective surface of an annular ring 3091. The axes of the keyways on the front and back surfaces are crisscrossing each other at the center of the annular ring 3091. In respective keyways, the orbiting scroll member 3020 and a key 3100 affixed to a housing 3048 are engaged each other with a minute gap therebetween, thereby forming rotation-prevention mechanism.

FIG. 26 and FIG. 27 are perspective views showing another conventional annular ring 4061 disclosed in Japanese examined published utility model Sho 62-21756. In FIG. 26, two pairs of keys are formed on both surfaces of the annular ring 4061, thereby to engage with keyways formed in the orbiting scroll member etc. FIG. 27 shows a still other ring having four oppositely disposed keyways. FIG. 28 is a plane view showing a still other ring disclosed in Japanese unexamined patent publication Sho 53-34107. Four keys, which correspond to the keys 4059 in FIG. 26, are rotatably held on the ring. Thus, reduction of weight of the rotation-prevention parts and improvement of wear-resistivity of the keys have been achieved.

The load torque, which acts on the parallelly disposed keys of the rotation-prevention parts, is made by orbiting inertia of the orbiting scroll member and friction force acting on the bearing by which the driving shaft and the orbiting scroll member are engaged each other. Therefore, excessive large torque is applied to the parallelly disposed key of the rotation-prevention parts when the load is great at high speed running or overload running of the compressor. Therefore, enough rigidity to withstand the torque is required for the rotation-prevention parts. However, in order to lighten the rotation-prevention parts, an apparatus for reducing level of overload is indispensable.

In FIG. 21 and FIG. 22, since compression ratio of the scroll compressor is constant, pressure in the compression chamber abnormally rises at the time for instance when fluid-compression is caused by injection of lubricating oil into the compression chamber. At that time, an end plate of the orbiting scroll member 1001 can move only within minute gaps among itself, the fixed scroll member 1002 and the frame 1008 in the axial direction. Therefore, it is impossible to reduce the pressure in the compression chamber. As a result, increase of compression load, damage on the parts and declination of durability occur in the compressor. Further, jumping of the orbiting scroll member occurs at the time of liquid-compression, thereby resulting in abnormal vibration and noise.

FIG. 30 is a cross-sectional view showing a still other conventional scroll compressor disclosed in the U.S. Pat. No. 3,600,114. This compressor is constructed by utilizing pressure of compression fluid and spring means in order to overcome the above-mentioned liquid-compression. In the figure, a fixed scroll member 2001*e* is slidably mounted in the axial direction thereof. By means of back pressure in a back pressure chamber 2015 whereto discharge pressure is led and spring force of a leaf spring 2023, the fixed scroll member 2001*e* is pushed onto the orbiting scroll member 2001*d*. Axial gaps between the orbiting scroll member 2001*d* and the fixed scroll member 2001*e* substantially become zero, thereby radially closing the compression chamber and improving compression efficiency. When the pressure in the compression chamber abnormally rises owing to liquid-compression etc., the fixed scroll member 2001*e* moves away from the orbiting scroll member 2001*d* in the axial direction thereof. Pressure inteh compression chamber is thereby lowered, and the load is decreased. However, in the compressor such that the fixed scroll member 2001*e* is always pushed onto the orbiting scroll member 2001*d* with constant pushing force, it becomes necessary to urge the scroll member by considerably stronger force than optimum pushing force for steady running state. That is, in order to stably avoid the state such that both scroll members are detached from each other in the axial direction by means of pressure of compression fluid which varies in accordance with the running state of the compressor or that the fixed scroll member 2001*e* tilts during orbiting motion of the orbiting scroll member 2001*d*. As a result of such large pushing force, friction between both scroll members results in considerable wear thereof, and thereby durability is low and power loss is large. When the pushing force applied to the fixed scroll member 2001*e* is selected to be optimum at the steady-state, detaching and touching between both scroll members 2001*d* and 2001*e* and tilting of the fixed scroll member 2001*e* are repeated at every time when pressure in the compression chamber is changed over the predetermined value. At that time, large vibration and noise occur, and durability of contacting surfaces of both scroll members is lowered.

The U.S. Pat. No. 3,817,664 shows another overload-prevention construction in which the orbiting scroll member moves perpendicular to a main driving shaft. However, this construction has several shortcomings. For instance, its construction is complicated and cost is high. Further, it is difficult to improve vibration and noise characteristics, and extra space for an overload-reduction mechanism is necessary, thereby resulting in undesirable enlargement of size of the compressor.

As to the rotation-prevention parts shown in FIGS. 28 and 29, since many parts are required therefor, high cost is unavoidable, and further, reduction of weight of the rotation-prevention parts is difficult.

In FIGS. 24–27, each annular ring has the configuration combined with the parallelly opposing keys or the keyways, thereby to reduce a back lash on the orbiting scroll member in orbiting direction thereof and leakage of compressed gas. It is therefore necessary to precisely finish the parallelism of sliding parts and widths of the keyways and keys. Accordingly, cutting of the keyways and the side of the parallely opposing keys must be peformed on every surface of the ring, and thereby it takes a long time to fix/remove jigs to/from the work and to cut the work. Therefore, mass-production of such rings is not easy.

Besides, in making preliminary shape before cutting by such mass-production method as stamping or sintering, the annular ring tends to warp owing to its known configuration having uneveness on both surfaces thereof. To prevent the warp, size and thickness of original sheet metal is restricted. Therefore, there is a limit to reduce weight of the ring etc. Moreover, the more working steps are, the more expensive costs of material and working are.

Thus, no conventional scroll compressor can equip all desirable features, i.e., low cost, excellent characteristics of vibration and noise, compact size and light weight of rotation-prevention parts and overload-prevention means having substantially effective performance.

OBJECT AND SUMMARY OF THE INVENTION

The object of the present invention is to offer a scroll compressor which can reduce vibration and noise at any time and has excellent durability.

In order to achieve the above-mentioned object, the scroll compressor in accordance with the present invention comprises:

a stationary case;

a first scroll member held by the case;

a second scroll member which is orbitably held from the case and to be engaged with the first scroll member, to form compression chambers;

driving means which is held from case and makes orbiting motion to drive second scroll member;

supporting means which is movably held and urged from the case to support thrust force of the second scroll member against the first scroll member within a predetermined stroke in an axial direction of the scroll members, the smallest gap between the supporting means and the first scroll member being larger than thickness of a part of the second scroll member put therebetween; and rotation-prevention means which is movably held by the supporting means and engaged with the second scroll member to prevent the second scroll member from rotating.

In the above-mentioned scroll compressor, vibration and noise are reduced at any time, and compression-efficiency and durability of sliding surfaces are improved. Moreover, overload of the compressor is quickly eliminated, and size of the compressor is further miniaturized.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

in FIG. 15.

It will be recognized that some or all of the Figures are schematic representations for purposes of illustration and do not necessarily depict the actual relative sizes or locations of the elements shown.

DESCRIPTION OF THE PREFERRED EMBODIMENT

Hereafter, preferred embodiments of the present invention are described with reference to the accompanying drawings.

Figure 1:
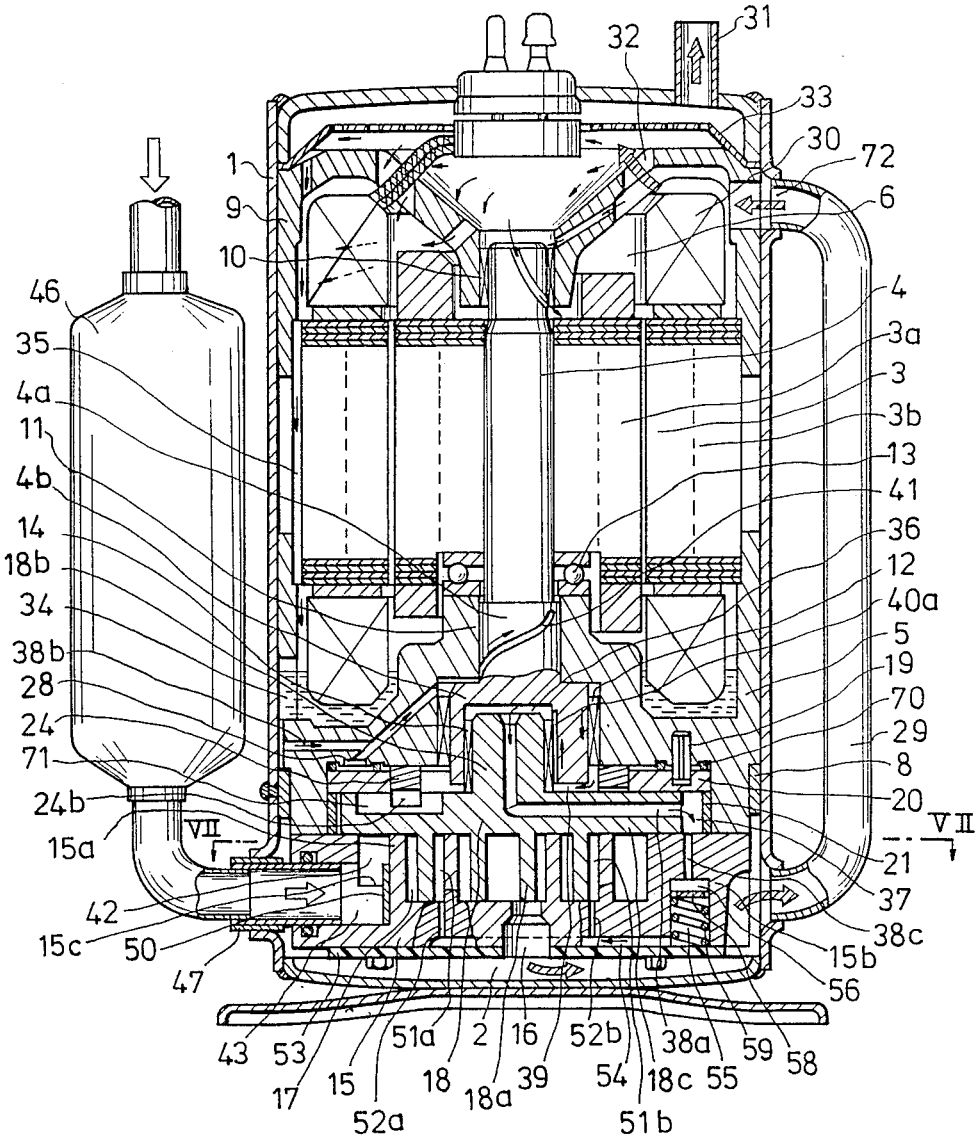
FIG. 1 is a cross-sectional view showing a scroll compressor of a first embodiment of the present invention.

FIG. 1 is a cross-sectional view showing a scroll compressor of a first embodiment. In the figure, an internal space of an enclosed case 1 made of steel is communicated with a delivery chamber 2 and is filled with high-pressure gas such as refrigerant. A motor 3 is provided in the upper side of the case 1, and a compression part is provided in the lower side thereof. A rotor 3*a* of the motor 3 is fixed on a driving shaft 4, and the internal space of the case 1 is partitioned by a main frame 5 of the compression part into a motor chamber 6 and the delivery chamber 2. An alloy of aluminum having excellent heat conductivity is employed for material of the main frame 5 for the purpose of reduction of weight and heat irradiation at a bearing part. A steel liner 8 which is convenient for welding is shrunk on an outer surface of the main frame 5. An all outer surface of the liner 8 touches an inner surface of the case 1, and the liner 8 and the case 1 are partially welded to each other. Both outer end surfaces of a stator 3*b* of the motor 3 are held by the main frame 5 and a sub-frame 9 which is inscribed to the case 1. A driving shaft 4 is rotatably held by an upper side bearing 10 fixed into the sub-frame 9, a lower side bearing 11 formed on an upper end part of the main frame 5, a main bearing 12 fixed at the center of the main frame 5 and a thrust ball bearing 13 fixed between an upper end surface of the main frame 5 and a lower end surface of the rotor 3*a* of the motor 3. An eccentric bearing 14 is provided at lower end part of the driving shaft 4 in a manner that an axis of the eccentric bearing 14 is eccentrically disposed against that of the driving shaft 4. A fixed scroll member 15 made of an alloy of aluminum is fixed to a lower end of the main frame 5. The fixed scroll member 15 comprises a scroll-shaped fixed scroll wrap 15*a* and an end palte 15*b*. At the center of the end plate 15*b*, namely at wrapping start point of the fixed scroll wrap 15*a*, a discharge port 16 is formed to communicate with the delivery chamber 2. A suction chamber 17 is formed outside the fixed scroll wrap 15*a*. An orbiting scroll member 18 comprises a scroll-shaped orbiting scroll wrap 18*a*, an orbiting shaft 18*b* and a disk-shaped plate 18*c*. The orbiting scroll wrap 18*a* is engaged with the fixed scroll wrap 15*a* to thereby form a compression chamber having moving fluid pockets of variable volume therebetween. The orbiting shaft 18*b* is held by the eccentric bearing 14 of the driving shaft 4 and is disposed to erect on the disk-shaped plate 18*c*. The orbiting scroll member 18 made of alloy of aluminum is surrounded by the fixed scroll member 15, the main frame 5 and the driving shaft 4. A sleeve 4*b* which is made of high stength steel is shrunk onto an outer surface of the eccentric bearing 14. Surfaces of the disk-shaped plate 18*c* are hardfaced.

Movement of a thrust bearing 20 is restricted by a pair of split cotters 19 fixed to the main frame 5 only in the axial direction thereof. A spacer 21 is provided between the thrust bearing 20 and the end plate 15*b* of the fixed scroll member 15, and length of the spacer 21 in the axial direction is about 0.015–0.020 mm larger than thickness of the disk-shaped plate 18*c* in the axial direction in order to allow to form an oil film for sealing on the surfaces of the disk-shaped plate 18. A space 36, which is formed between a bottom part of the sleeve 4*b* of the driving shaft 4 and the orbiting shaft 18*b* of the orbiting scroll member, and a space 37, which is formed around the disk-shaped plate 18*c*, are communicated each other through an oil passage 38*a* formed in the disk-shaped plate 18*c*.

Figure 2:
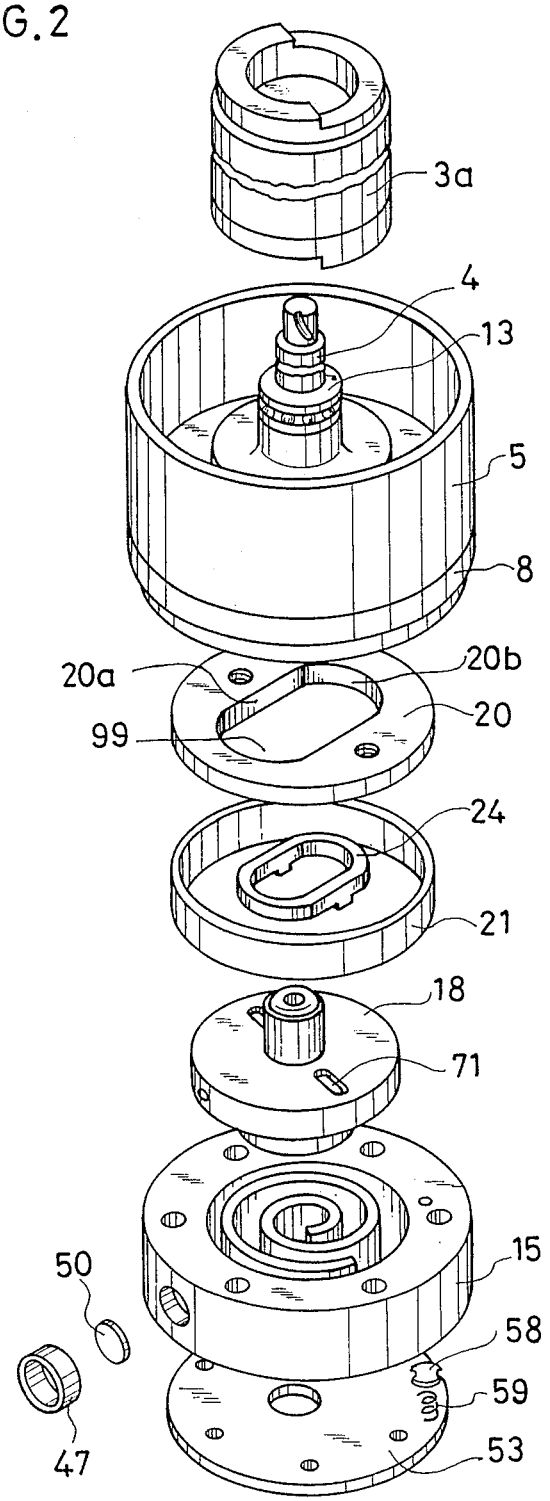
FIG. 2 is a perspective view showing major parts of a scroll compressor shown in FIG. 1.
Figure 5:
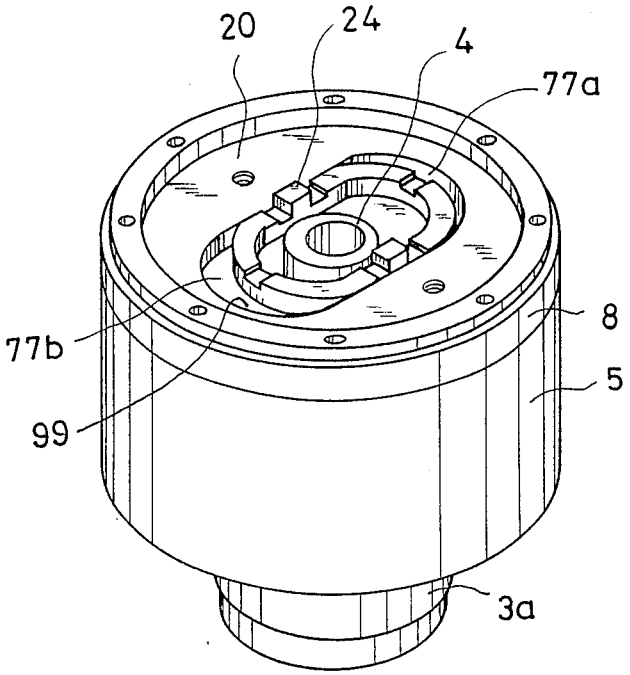
FIG. 5 is a perspective view mainly showing the state that an oldham ring 24 is slidably engaged with a thrust bearing 20.
Figure 6:
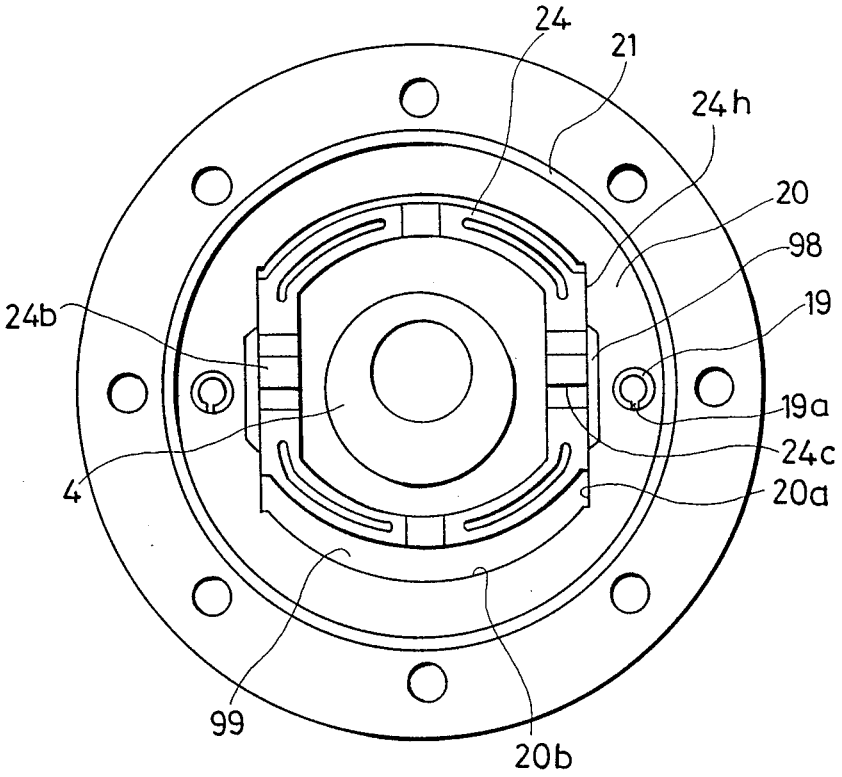
FIG. 6 is a plane view of FIG. 5.

FIG. 2 is a perspective view showing major parts of the scroll compressor shown in FIG. 1, and FIG. 5 is a perspective view showing the main frame 5 etc. of FIG. 1. FIG. 6 is a plane view of FIG. 5. In these figures, the thrust bearing 20 is made of sintered alloy which is easy to form through a snap flask etc. A guide hole 99 is precisely formed in the thrust bearing 20 to have a pair of parallelly opposing straight portions 20*a* and a pair of arc-shaped portions 20*b*. At the center of the straight portion 20*a*, a relief concave 98 (FIG. 6) is formed. A split portion 19*a* (FIG. 6) of the cotter 19 is directed toward the same direction as that of the other, and the direction of which is in parallel with the straight portion 20*a*.

Figure 4:
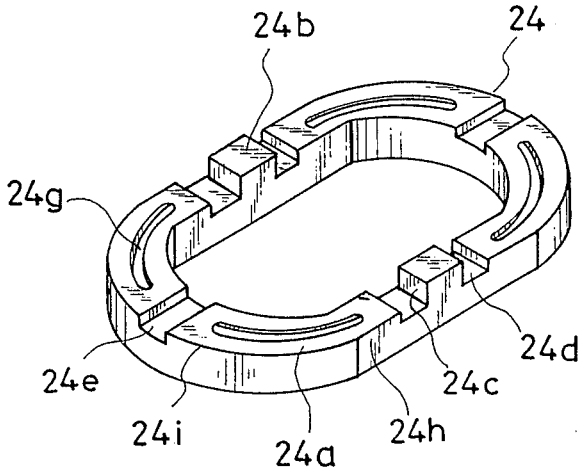
FIG. 4 is a perspective view showing an oldham ring 24 in FIG. 1.

A rotation-prevention part (hereinafter is referred as an oldham ring) 24 is made of light alloy or fiber-reinforced resin which are suitable for sintering or injection molding and have inherently oil impregnatable characteristic. FIG. 4 is a perspective view showing the oldham ring 24. In order to lighten weight, the oldham ring 24 comprises thin arc-shaped portions 24*a* and a pair of key portions 24*b*. Each upper surface of the arc-shaped portions 24*a* is in parallel with each lower surface thereof, and two key portions 24*b* are parallelly disposed on the same surface to each other. Thickness of each arc-shaped portions 24*a* is slightly smaller than that of the thrust bearing 20 (FIG. 5). A radially outer surface of the oldham ring 24 is formed by a pair of straight portions 24*h* and a pair of arc-shaped portios 24*i* adjoined the straight portions 24*h*. In FIG. 6, each of the straight portions 24*h* can slide on each of the straight portions 20*a* with a minute gap therebetween. A side wall 24*c* of each of the key portions 24*b* is disposed to hold right angle to each of the straight portions 20*a* at each center of the straight portions 20*a*. As shown in FIGS. 1 and 2, each of the key portions 24*b* is inserted into each of a pair of key holes 71 which are formed in the disk-shaped plate 18*c* of the orbiting scroll member 18, and is slidably engaged therewith. Configuration of an inner circumference of the acr-shaped portion 24*a* (FIG. 4) is similar to that of an outer circumference. In FIG. 4, a pair of shallow concavities 24*d* which are formed beside each of the key portions 24*b* can serve as passages of lubricating oil. A pair of very shallow concavities 24*e* also serve a passages of lubricating oil. Four arc-shaped narrow grooves 24*g* serve to store the lubricating oil.

Figure 3:
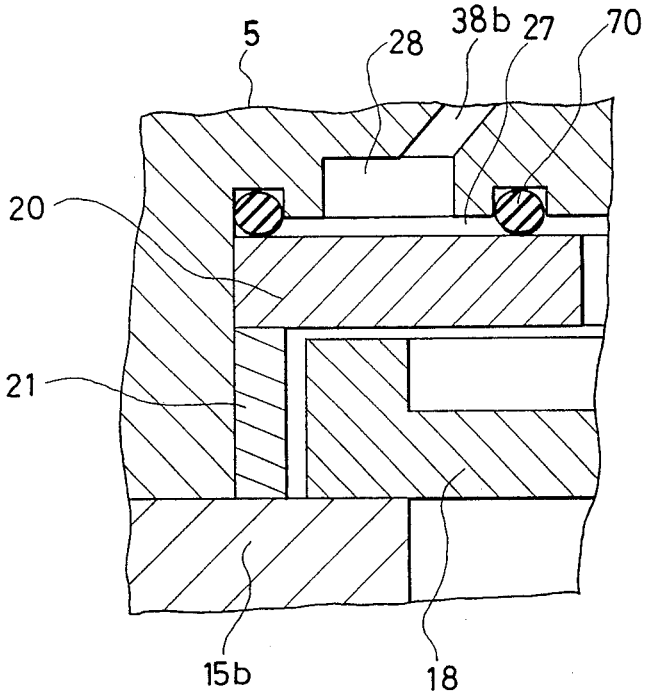
FIG. 3 is a partially enlarged cross-sectional view showing only a thrust bearing 20 and peripheral parts thereof in FIG. 1.

As shown in FIG. 1 and FIG. 3 in detail, there is a gap 27 of about 0.05 mm between the main frame 5 and the thrust bearing 20. A circular hole 28 opened to the gap 27 is formed in the main frame 5 in a manner to be disposed above the whole thrust bearing 20, and a pair of rubber seal rings 70 are provided between the main frame 5 and the thrust bearing 20 so as to put the hole 28 therebetween.

In FIG. 1, an upper part of the motor chamber 6 and the delivery chamber 2 are communicated each other through a bypassing delivery pipe 29 which is connected to a side wall of the case 1. A communicating aperture 72 of the bypassing delivery pipe 29 with the motor chamber 6 is beside an upper coil end part 30 of the stator 3*b*. The aperture 72 and a delivery pipe 31 are communicated each other through a through-hole 32 formed in the sub-frame 9 and a punched plate 33 which has a lot of small holes and is disposed between a top part of the case 1 and the sub-frame 9.

An oil pool 34 provided in a lower part of the motor chamber 6 is communicated with the upper part of the motor chamber 6 through a cooling passage 35 which is formed by cutting a part of outer circumferential surface of the stator 3*b*. The oil pool 34 is also communicated with the circular hole 28 through an oil passage 38*b* formed in the main frame 5. Further, the oil pool 34 is communicated with a back pressure chamber 39, which is formed on the orbiting scroll member 18, through a minute gaps around the main bearing 12. The back pressure chamber 39 is communicated with the space 36 in the eccentric sleeve 4*b* through an oil groove 40*a* formed in the eccentric sleeve 4*b*.

The oil passage 38*b* is also communicated with a spiral oil groove 41 which is formed on an outer circumferential surface of lower part 4*a* of the driving shaft 4. The lower part 4*a* faces the lower side bearing 11, and the oil groove 41 is extended to an intermediate part of the lower part 4*a*. Configuration of the spiral oil groove 41 is determined so as to generate pump action utilizing viscosity of lubricating oil during forward-rotation.

Figure 7:
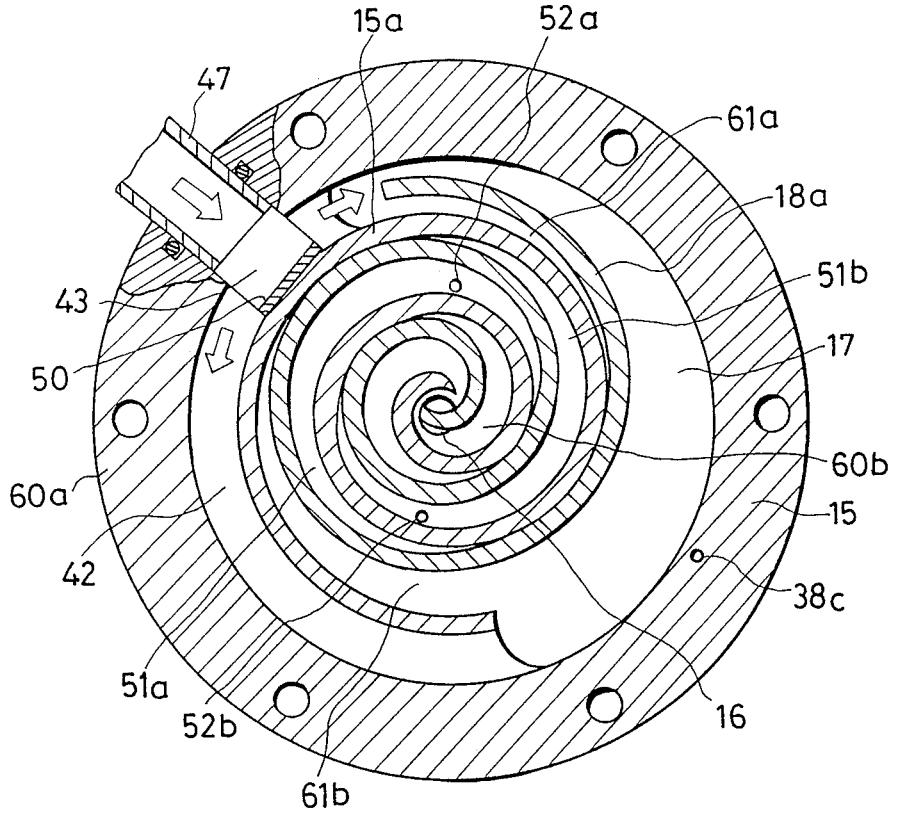
FIG. 7 is a cross-sectional view taken on line VII—VII in FIG. 1.
Figure 8:
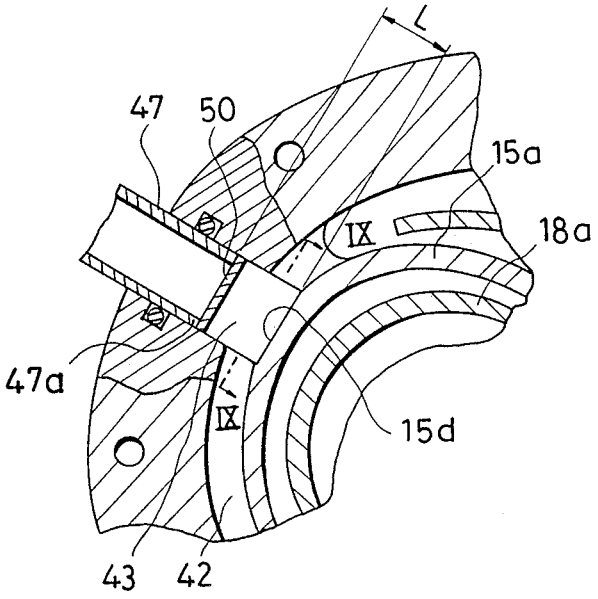
FIG. 8 is a cross-sectional view showing a part of FIG. 7.
Figure 9:
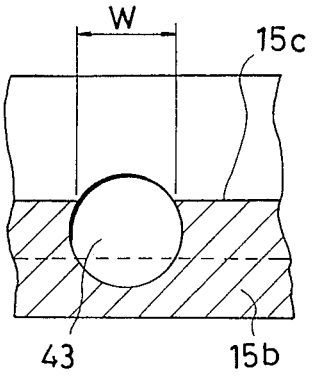
FIG. 9 is a cross-sectional view taken on line IX—IX in FIG. 8.

FIG. 7 is a cross-sectional view taken on line VII—VII of FIG. 1, and FIG. 8 is a partially enlarged view of FIG. 7. In the fixed scroll member 15 (FIG. 7), both ends of the suction chamber 17 are communicated with an arc-shaped suction passage 42. A cylindrical suction hole 43 is formed in the fixed scroll member 15 across the suction passage 42. An axis of the suction hole 43 and an end wall 15*d* (FIG. 8) formed on the fixed scroll wrap 15*a* are at right angles to each other. The end wall 15*d* is a circular plane, and the suction hole 43 is terminated thereat. FIG. 9 is a cross-sectional view taken on line IX—IX of FIG. 8. As shown in FIG. 9, the center of the suction hole 43 is away from a floor surface 15*c* (namely an upper surface (FIG. 1) of the fixed scroll member 15), and an aperture-width W of the suction hole 43 is slightly smaller than a diameter of the suction hole 43. In FIG. 1, the suction hole 43 is communicated with a suction pipe 47 of an accumulator 46. In FIG. 8, a circular check valve 50 of thin steel is inserted into the suction hole 43 and is movable from an end part 47*a* of the suction pipe 47 (namely the state in FIG. 8) to the end wall 15*d* (namely the state in FIG. 7). A diameter of the check valve 50 is larger than any one of an inner diameter of the suction piper 47, a length L between the end part 47*a* and the end wall 15*d* and the aperture-width W. Polytetrafluoroethylene or rubber, which repels oil and is elastic, is coated on the check valve 50.

Figure 10:
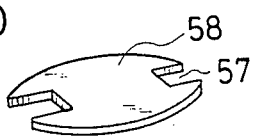
FIG. 10 is a perspective view showing a check valve 58 in FIG. 1.

In FIGS. 1 and 7, second compression chambers 51*a* and 51*b*, which are communicated with neither the suction chamber 17 nor the delivery chamber 2, are communicated with the space 37 through narrow injection holes 52*a* and 52*b*, an injection groove 54, an injection passage 55 and an oil passage 38*c*. The injection holes 52*a* and 52*b* are formed in the end plate 15*b*, and the injection groove 54 and the injection passage 55 are formed between the end plate 15*b* and an adiabatic cover 53 made of resin. The oil passage 38*c* is formed in the end plate 15*b*. In the injection passage 55, a steel check valve 58 and a coil spring 59 are provided. FIG. 10 is a perspective view showing the steel check valve 58 having a pair of cut-off portions 57 on a circumference thereof.

Figure 11:
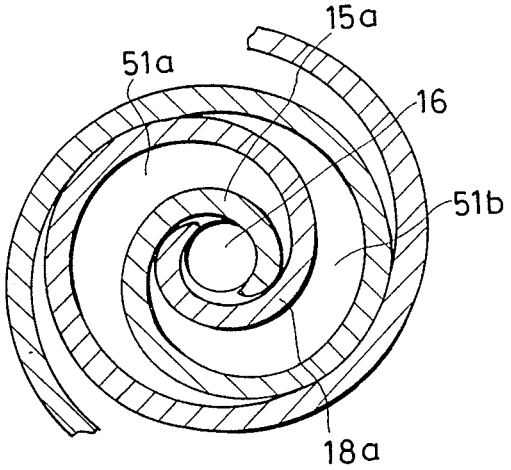
FIG. 11 and FIG. 12 are cross-sectional illustrations showing cooperating action of an orbiting scroll wrap 18*a* and a fixed scroll wrap 15*a*.
Figure 12:
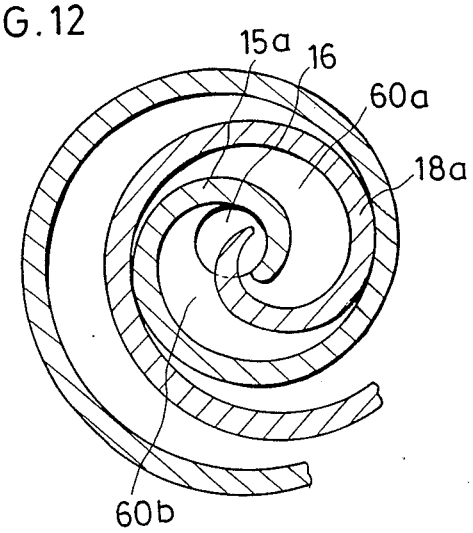

The coil spring 59 (FIG. 1) always urges the check valve 58 upward with a lower end thereof held by the adiabatic cover 53. The oil passage 38*c* is communicated with the space 37 at the time when the orbiting scroll member 18 orbits into a position shown in FIG. 11. This state means to be near ending state of volume-decrease-step of third compression chambers 60*a* and 60*b* (FIG. 12) which are to be communicated with the discharge port 16. Except the above-mentioned time, an upper opening of the oil passage 38*c* is closed by the disk-shaped plate 18*c*. (FIG. 1) of the orbiting scroll member 18.

Figure 13:
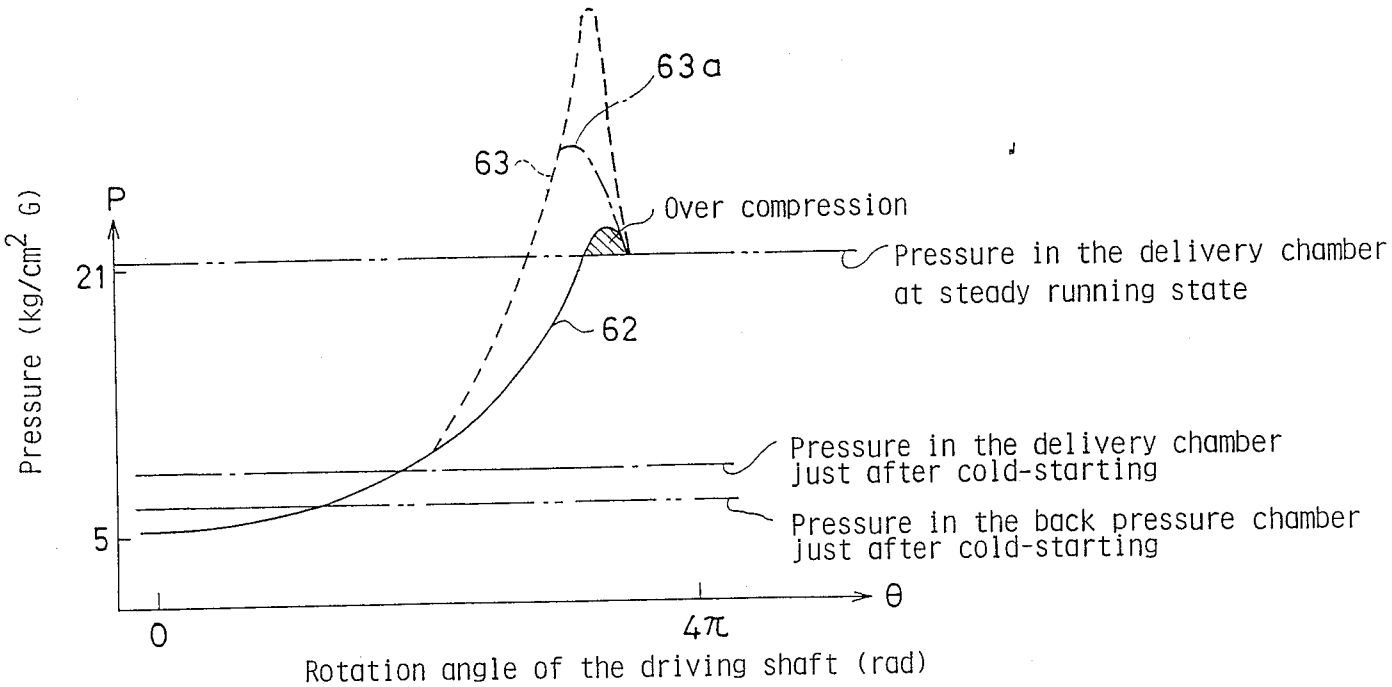
FIGS. 13 and 14 are graphs showing characteristics of pressure of refrigerant gas versus rotation angle of a driving shaft 4 (FIG. 1).

FIG. 13 is a graph showing characteristic of pressure of refrigerant versus rotation angle of the driving shaft 4 during suction step, compression step and discharge step. A solid curve 62 shows change of pressure during that the compressor is driven with normal pressure, and a dotted curve 63 shows change of pressure during that abnormal pressure is generating in the compressor.

Figure 14:
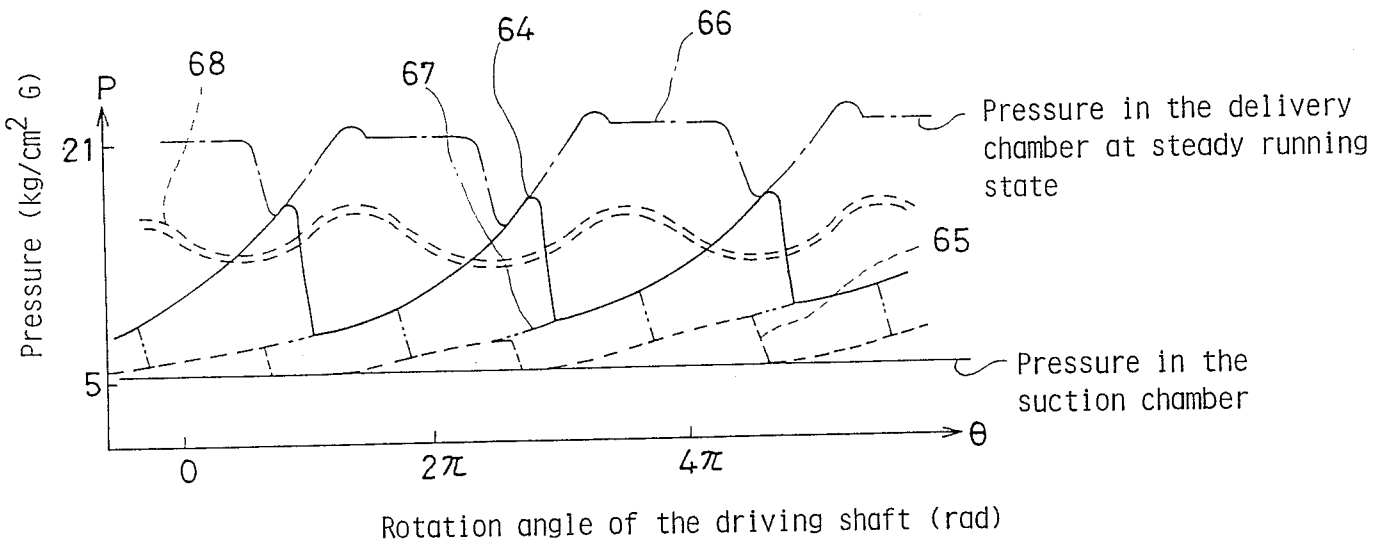

FIG. 14 is also a graph which is similar to FIG. 13. A solid curve 64 shows change of pressure in the second compression chambers 51*a* and 51*b* at opening positions of the injection holes 52*a* and 52*b*, respectively. A dotted curve 65 shows change of pressure in first compression chambers 61*a* and 61*b* (FIG. 7) which are communicated with the suction chamber 17 at predetermined positions. A chain curve 66 shows change of pressure in the third compression chambers 60*a* and 60*b* which are communicated with the delivery chamber 2 at predetermined positions. A chain curve 67 shows change of pressure at predetermined positions between the first compression chambers 61*a* and 61*b* and the second compression chambers 51*a* and 51*b*. A doubole dotted line 68 shows change of pressure in the back pressure chamber 39.

Next, operation of the above-mentioned scroll compressor is described. In FIG. 1, when the driving shaft 4 is rotated by the motor 3, the orbiting scroll member 18 is about to rotate around an axis thereof via crank mechanism of the driving shaft 4. But, since each of the key portions 24*b* is engaged with each of the key holes 71 of the orbiting scroll member 18 and also each of the straight portions 24*h* (FIG. 4) is engaged with each of the straight portions 20*a* (FIG. 6) of the thrust bearing, rotation of the orbiting scroll member 18 around its axis is prohibited, and only orbiting around an axis of the driving shaft 4 is allowed. By orbiting motion of the orbiting scroll member 18, volumes of respective compression chambers which are formed between the orbiting scroll member 18 and the fixed scroll member 15 are changed, and thereby sucking and compressing of the refrigerant gas are performed. The refrigerant gas containing lubricating oil is supplied from another refrigerating cycle apparatus connected to the compressor to the accumulator 46. This refrigerant gas is led into the suction chamber 17 through the suction pipe 47, the suction hole 43 and the suction passage 42 in this order, and is taken into the first compression chambers 61*a* and 61*b* which are formed between the orbiting scroll member 18 and the fixed scroll member 15. Further, the refrigerant gas is moved to the second compression chambers 51*a* and 51*b* and the third compression chambers 60*a* and 60*b* in this order, and the refrigerant gas is thereby compressed more and more. Finally, the refrigerant gas is delivered to the delivery chamber 2 through the discharge port 16.

At early stage after starting of the compressor from the balanced-state of pressure in the compressor, the orbiting scroll member 18 receives thrust force in an opposite direction (upward in FIG. 1) to the discharge port 16 by pressure of pressurized refrigerant gas in the compression chamber. However, since back pressure, which is to be used to push the orbiting scroll member 18 downward, has not been generated yet, the orbiting scroll member 18 moves upward in FIG. 1 away from the fixed scroll member 15 and is supported by the thrust bearing 20. At that time, a gap of about 0.015–0.020 mm is formed between both scroll members 15 and 18 in the axial direction thereof. Some amount of the refrigerant gas flows into an adjacent low-pressure side of the compression chamber through the gap, thereby temporarily lowering pressure in the compression chamber. Compression load at the early stage from starting is thus reduced.

Figure 30:
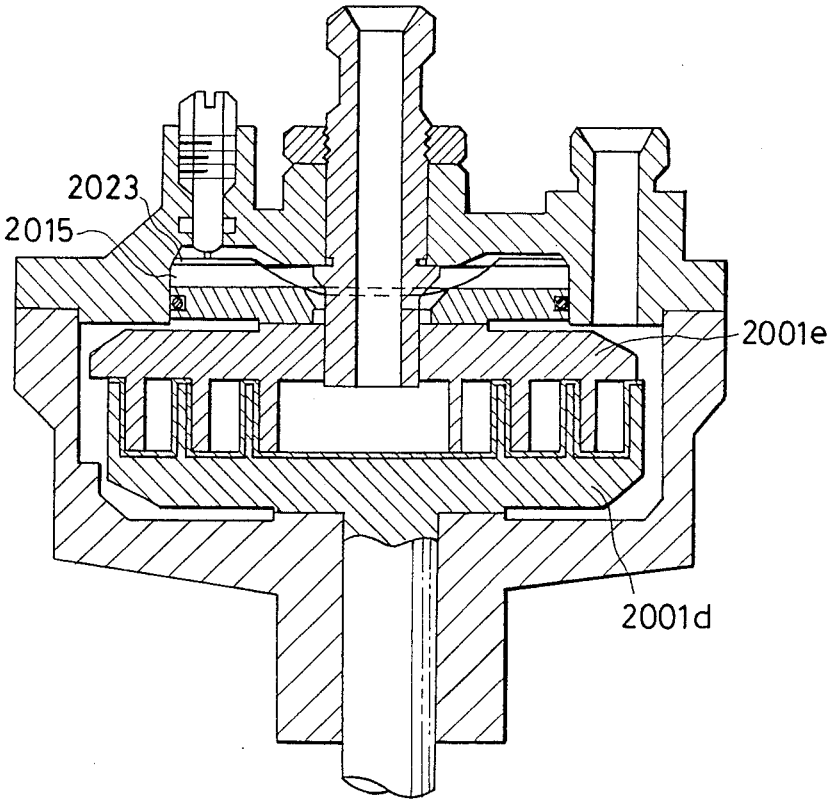
FIG. 30 (Prior Art)
FIG. 30 is the cross-sectional view showing still other conventional scroll compressor.

Initial supporting force by which the orbiting scroll member 18 is supported on the thrust bearing 20 is given by elastic force of the seal ring 70 and auxiliary force of spring means (not shown, but is for instance, that like the leaf spring 2023 in FIG. 30).

When liquid-compression occurs in the compression chamber thereby resulting in abnormal temporary rise of pressure, thrust force acting on the orbiting scroll member 18 becomes larger than pushing force acting on a back (upper) surface of the orbiting scroll member 18. As a result, the orbiting scroll member 18 moves in the axial direction (upward in FIG. 1) thereof, and thereby the disk-shaped plate 18*c* is detached from the end plate 15*b* of the fixed scroll member 15 and supported by the thrust bearing 20. At the same time, sealing of the compression chamber is broken off, thereby reducing pressure in the compression chamber and compression load.

Delivery refrigerant gas containing lubricating oil returns to the motor chamber 6 through the bypassing delivery pipe 29. At that time, the refrigerant gas collides with a side wall of the upper coiol end part 30 and is attached on a surface of coil-windings. Some amount of the lubricating oil is thereby separated from the refrigerant gas. Thereafter, the refrigerant gas passes through the through-hole 32 and the small holes of the punched plate 33. At the time of passing through the through-hole 32, flowing direction is changed, and at the time of passing through the punched metal 33, lubricating oil is further separated from the refrigerant gas by inertia of lubricating oil and attachment on the punched metal 33. The refrigerant gas is finally delivered to the external refrigerating cycle through the delivery pipe 31.

Some amount of the lubricating oil which is separated from the delivery refrigerant gas is served to lubricate on a bearing surface of the upper side bearing 10. After that, the lubricating oil passes through the cooling passage 35 together with the other lubricating oil, thereby cooling the motor 3. Finally, the lubricating oil is collected into the oil pool 34 in the delivery chamber.

Some amount of the lubricating oil stored in the oil pool 34 is supplied to the thrust ball bearing 13 by screw pump action of the spiral oil groove 41. By sealing-effect of very thin oil film which is formed on the surface of the lower part 4*a* of the driving shaft 4 by the lubricating oil passing therethrough, delivery refrigerant gas in the motor chamber 6 is gas--tightly separated from a space above the main bearing 12.

Lubricant oil which contains dissolved delivery refrigerant gas passes through minute gaps of the main bearing 12, thereby reducing pressure thereof into medium pressure of sucking pressure and delivery pressure. Thereafter, the lubricating oil of medium pressure flows into the back pressure chamber 39.

In FIG. 5, the oldham ring 24 is reciprocated within the guide hole 99 of the thrust bearing 20, and thereby volumes of a pair of spaces 77*a* and 77*b*, which are formed between the oldham ring 24 and the thrust bearing 20, are repeatedly changed. That is, these spaces 77*a* and 77*b* serve as pump chambers. Further, the concavities 24*e* (FIG. 4) serve as suction passages and the concavities 24*d* (FIG. 4) serve as delivery passages. Thus, the oldham ring 24 (FIG. 4) serves as a pump-route. Lubricant oil in the back pressure chamber 39 is circulated through the above-mentioned pump-route, thereby lubricating sliding surfaces about the oldham ring 24. On the other hand, lubricating oil flows into the space 37 through the oil groove 40*a*, the space 36 and the oil passage 38*a* with pressure thereof gradually reduced in this order. Further, the lubricating oil passes through the oil passage 38*c* which is cyclically opened, the injection groove 54 and the injection holes 52*a* and 52*b* in this order accompanied by lubrication on each sliding surface and finally reaches the second compression chambers 51*a* and 51*b*.

Since the oil pool 34 is also communicated with the circular hole 28 and the gap 27 (FIG. 3), the thrust bearing 20 is urged to push an upper end of the spacer 21 (FIG. 1) by back pressure given thereto. The disk-shaped plate 18*c* of the orbiting scroll member 18 smoothly slides with minute gaps formed between the thrust bearing 20 and the end plate 15*b* of the fixed scroll member 15. Also, gaps between the fixed scroll wrap 15*a* and the disk-shaped plate 18*c* and gaps between the orbiting scroll wrap 18*a* and the end plate 15*b* are kept minute, thereby to reduce leakage of refrigerant gas from/to adjacent compression chamber.

At respective apertures of the injection holes 52*a* and 52*b* in the second compression chamber 51*a* and 51*b*, pressure is changed as shown by the solid curve 64 in FIG. 14. Instantaneous value of this pressure can be larger than the pressure (shown by the double dotted curve 68) in the back pressure chamber 39, which is changed in response to the pressure in the delivery chamber 2. but mean value thereof is lower than that. Therefore, in FIG. 1, lubricating oil intermittently flows into the second compression chambers 51*a* and 51*b* from the back pressure chamber 39. Even when the instantaneous value (the curve 64) of the pressure in the second compression chamber 51*a* and 51*b* becomes larger than the pressure (the curve 68) in the back pressure chamber 39 under normal running state, the instantaneous pressure is reduced through narrow injection holes 52*a* and 52*b*. Instantaneous back flow to the injection groove 54 is thereby minimized, and pressure in the injection groove 54 can not become larger than the pressure (the curve 68) in the back pressure chamber 39.

Lubricant oil injected to the second compression chambers 51*a* and 51*b* joins with lubricating oil, which has flowed into the compression chamber together with suction refrigerant gas, and forms oil film to seal minute gaps between both secroll members 15 and 18, thereby preventing leakage of refrigerant gas. While forming the oil film, the lubricating oil is delivered into the delivery chamber 2 again together with the compressed refrigerant gas.

As aforementioned, at the early stage after starting of the compressor, the orbiting scroll member 18 is supported by the elastic force of the seal ring 70 or the spring means via the thrust bearing 20. Further, the orbiting scroll member 18 receives pushing force of medium pressure by lubricating oil which is supplied to the back pressure chamber 39 in the steady running state, and thereby the disk-shaped plate 18*c* is pushed on the end plate 15*b* with the oil film formed therebetween. The space 37 is thus gas-tightly separated from the suction chamber 17. The lubricating oil in the back pressure chamber 39 also enters gaps (about 0.015–0.020 mm) between sliding surfaces of the thrust bearing 20 and the disk-shaped plate 18*c*, thereby sealing the gaps.

As shown in FIG. 13 and FIG. 14, the pressure in the delivery chamber 2 is larger than the pressure in the second compression chamber 51*a* and 51*b* in a short time after cold-starting. Meanwhile, refrigerant gas under compression is about to backwardly flow into the back pressure chamber 39 from the second compression chamber 51*a* and 51*b* through the injection passage 55. But, the check valve 58 stops the back flow to the space 37. When the pressure in the delivery chamber 2 gradually rises, lubricating oil in the oil pool 34 is sent to the back pressure chamber 39 and the space 37 by differential pressure therebetween. When the pressure in the delivery chamber 2 further rises, lubricating oil in the space 37 is injected against the urge of the coil spring 59 into the second compression chambers 51*a* and 51*b* through the injection holes 52*a* and 52*b*.

When pressure of suction refrigerant gas is very high at just after cold-starting, pressure in the compression chamber is compressed through constant compression ratio and results in extremely high pressure. Also, the pressure in the compression chamber becomes extremely high in case of liquid-compression. At the above-mentioned states, the orbiting scroll member 18 is detached from the fixed scroll member 15 and supported by the thrust bearing 20. However, the thrust bearing 20 urged by back pressure cannot support thrust force which is generated from abnormally high pressure in the compression chamber and acts on the orbiting scroll member. Consequently, the orbiting scroll member 18 moves upward (FIG. 1), so that the gap 27 (FIG. 3) is reduced and the gaps between both scroll members 15 and 18 are enlarged in the axial direction.

Even if the thrust bearing 20 is backed in the axial direction to contact with the main frame 5, reciprocation of the oldham ring 24 is smoothly continued. Therefore, pressure in the compression chamber is rapidly lowered by a lot of leakage of the refrigerant gas, thereby reducing compression load instantaneously. After that, the thrust bearing 20 immediately returns to the regular position. Thus, pressure in the back pressure chamber 39 is not so much lowered, and stable running state is continued.

If an alien substance is put in the gaps between the orbiting scroll member 18 and the fixed scroll member 15 in the axial direction, the thrust bearing 20 is backed in the same way mentioned above, thereby removing the alien substance.

When instantaneous liquid-compression occurs at an early stage from the cold-starting or steady running state, pressure in the compressor chamber abnormally rises as shown by the dotted curve 63 (FIG. 13), thereby resulting in over-compression. But, since volume of high pressure space, which is formed by the delivery chamber 2 and subsequent space thereto, is sufficiently large, rise of pressure in the delivery chamber is very slight.

Even when pressure in the injection groove 54 which is communicated with the second compression chambers 51*a* and 51*b* also rises abnormally by the liquid-compression, pressure in the space 37 is not affected owing to limiting effect of the narrow oil passage 38*c* and control of the check value 58. As a result, pressure in the back pressure chamber 39 is kept constant, and back pressure which urges to push a back surface of the thrust bearing 20 is kept constant. Thus, the thrust bearing 20 moves backward (upward in FIG. 1) by excessive thrust force acting on the orbiting scroll member 18 at the time of the liquid-compression, and thereby the pressure in the compression chamber is lowered, thereby enabling continuous running in normal state. Since the trust bearing 20 moves backward in the middle of the liquid compression, pressure in the compression chamber lowers as shown by the chain curve 63*a* (FIG. 13).

After stoppage of the compressor, the orbiting scroll member 18 receives reverse orbiting torque by pressure in the compressor. Thereby, the orbiting scroll member 18 orbits in the reverse direction, and delivery refrigerant gas backwardly flows to the suction chamber 17. Following to the back-flow of the delivery refrigerant gas, the check valve 50 moves from a position in FIG. 7 to a position in FIG. 8. At the position in FIG. 8, since the polytetrafluoroethylene film coated on the check valve 50 desirably seals the end part 47*a* of the suction pipe 47, back flow of the delivery refrigerant gas is dammed thereat. Reverse-orbiting of the orbiting scroll member 18 is thereby stopped, and a space from the suction passage 42 to the discharge port 16 is filled with the refrigerant gas of delivery pressure.

Although pressure in the injection groove 54 and a lower side of the injection passage 55 to the check valve 58 becomes the delivery pressure, pressure in a space from the space 37 to the back passage chamber 39 is kept to be medium pressure for a while. Thereafter, the pressure in the space from the space 37 to the back pressure chamber 39 gradually becomes to the delivery pressure by flowing-in of a small amount lubricating oil from the oil pool 34. When the compressor is stopped, the orbiting scroll member 18 orbits in the reverse direction and stops at a position where the third compression chambers 60*a* and 60*b* is enlarged. At that time, the upper end aperture of the oil passage 38*c* is closed by the disk-shaped plate 18*c*, and thereby communication between the space 37 and the oil passage 38*c* is interrupted.

Since the check valve 58 also seals the injection passage 55 by urging force of the coil spring 59 after stoppage of the compressor, flowing-in of the lubricating oil from the space 37 to the compression chamber is prevented.

When the compressor is driving, the space above the main bearing 12 is communicated with the oil pool 34, and a space below the main bearing 12 is communicated with the back pressure chamber 39 of medium pressure. Therefore, differential pressure is generated between both spaces across the main bearing 12, and the driving shaft 4 whereto the rotor 3*a* of the motor 3 is fixed is urged to move toward the orbiting scroll member 18. This urging force is received by the main frame 5 via thrust ball bearing 13. Thus, inclination of the driving shaft 4 within the upper side bearing 10 and the main bearing 12, which is caused by unbalance of the driving shaft 4 or compression load, is prevented, thereby prohibiting undesirable unbalanced bearing state of both bearings 10 and 12.

The main frame 5 of the alloy of aluminum expands due to temperature-rise in running state of the compressor, and thereby the liner 8 of steel expands, to tightly touch at inner surface of the case 1 with an outer circumferential surface thereof. Gas-tightness between the oil pool 34 and the delivery chamber 2 is thereby improved, and fixing between the main frame 5 and the case 1 is strengthened to thereby improve rigidity.

In the above-mentioned embodiment, lubricating oil in the oil pool 34 may be injected into the first compression chambers 61*a* and 61*b* in compliance with driving condition of the compressor.

Also, delivery refrigerant gas in the motor chamber 6 or medium-pressure refrigerant gas which is generated in the second compression chambers 51*a* and 51*b* etc. may be led into the gap 27 or the circular hole 28 in response to degree of overload or area on the thrust bearing 20 whereto back pressure is applied.

Next, structural features of the above-mentioned embodiment is described more in detail. As mentioned above, the orbiting scroll member 18 orbits without any direct pushing by the thrust bearing 20 during normal running state, and variable gaps between both scroll members 18 and 15 in the axial direction thereof are kept minute, thereby to minimize leakage of compression, friction and jumping stroke of the orbiting scroll member 18. Improvement of compression efficiency and reduction of vibration and noise are thus realized. On the other hand, at the time of overload, the gaps between both scroll members 18 and 15 in the axial direction are enlarged, and compressed fluid in the compression chamber is flown to the low pressure side through the gaps. Thereby, pressure in the compression chamber is lowered, to reduce compression load, vibration and noise caused by over-compression and compression loss and to further improve durability of sliding surfaces.

Although the discharge port 16 is formed in the fixed scroll member 15 in the above-mentioned embodiment, it may be formed in the orbiting scroll member 18 to obtain the similar effect as shown in U.S. Pat. No. 4,552,518.

Although the above-mentioned embodiment employs the construction that the gaps between both scroll members 18 and 15 in the axial direction of the compressor chamber are enlarged by moving the orbiting scroll member 18 backward in the axial direction thereof, the similar construction that the gaps as enlarged by moving the fixed scroll member 18 backward can be realized.

In the above-mentioned embodiment, since only the orbiting scroll member 18 is movable in the axial direction thereof, number of movable parts is decreased, thereby decreasing generating source of vibration and noise. Further, since the orbiting scroll member 18 which is lighter than the fixed scroll member 15 moves to release overload, response action for reducing overload is quick owing to comparatively small inertia of the orbiting scroll member 18. Reduction of overload is thereby efficiently obtained.

Further, when pressure in the compression chamber is in normal state, the orbiting scroll member 18, which is put between the fixed scroll member 15 and the thrust bearing 20 with minute gaps, smoothly orbits without inclination against the driving shaft 4 caused by compression of refrigerant gas, collision with sliding surfaces caused by jumping in the axial direction and the unbalanced bearing state. Thereby, minute gaps in the axial direction of the compression chamber are secured, to prevent leakage of compressed refrigerant gas. Therefore, the compressor has high and stable compression efficiency and less vibration and noise and is excellent in durability. Besides, a lot of liquid-refrigerant returns to the compression chamber from the refrigerant cycle at early stage from cold-starting, and pressure in the compression chamber abnormally rises by liquid-compression under the compression step, and thrust force acting on the orbiting scroll member 18 to urge it to detach from the fixed scroll member 15 becomes temporarily excessive valve. Even at that time, since the thrust bearing moves backward (toward the motor chamber 6) with the orbiting scroll member 18 held by itself, the gaps between the orbiting scroll member 18 and the fixed scroll member 15 are enlarged in the axial direction, thereby to break seal of both scroll members 18 and 15. As a result, pressure in the compression chamber is instantaneously lowered, thereby reducing compression load, and durability is improved.

Even if there is no occurrence of liquid-compression, pressure in the compression chamber at starting of the compressor becomes very higher than that at stable running state owing to the fact that suction pressure is comparatively high, and that compression ratio is constant. However, by optimizing usual urging force of the thrust bearing 20, load for starting compressor is reduced.

In the above-mentioned embodiment, pressure in the back pressure chamber 30 is made to be medium pressure, and the orbiting scroll member 18 is always pushed by auxiliary back pressure toward the compression chamber. Accordingly, urging force of back pressure applied to the thrust bearing 20 is reduced, and thereby movability of the thrust bearing 20 is excellent. As a result, when pressure in the compression chamber abnormally rises due to the liquid-compression etc., the orbiting scroll member 18 quickly moves backward away from the fixed scroll member 15 together with the thrust bearing 20. Pressure in the compression chamber at abnormal compression state is thereby quickly lowered. Moreover, miniaturization of the thrust bearing 20 contributes to that of the compressor.

Since the thrust bearing 20 is preliminary urged (pre-loaded) by elastic force from the seal ring 70 or the spring means, backward-movement of the thrust bearing by thrust force acting on the orbiting scroll is small at an early stage from starting of the compressor such that the pressure in the compression chamber temporarily rises and that the pressure in the back pressure chamber 39 is low. The gaps between the fixed scroll member 15 and the orbiting scroll member 18 are thereby kept within predetermined desirable value. Thus, too large gap which results in failure of compression is prevented, and the gap 27 (FIG. 3) above the thrust bearing 20 is enough large to allow the thrust bearing 20 to sufficiently move, thereby to release overload at the liquid-compression.

The above-mentioned pre-loaded construction utilizing elastic force of the seal ring 70 of rubber contributes to reduce cost of reduction means of compression load.

Further, since the check valve 58 which allows to flow only from the space 37 to the second compression chambers **51*a* and 51*b* is provided, back-flow of abnormally high pressure refrigerant gas from the second compression chambers 51*a* and 51*b* is prevented even in such state that thrust force acting on the orbiting scroll member 18 abnormally rises by abnormal high pressure in the compression chamber at such early stage from cold-starting that pressure of suction refrigerant gas is comparatively high or at the time of occurrence of liquid-compression. Therefore, pressure in the back pressure chamber 39, which acts on the orbiting scroll member 18 as back pressure, does not rise. As a result, the orbiting scroll member 18 is detached from the fixed scroll member 15, thereby enlarging the gaps between both scroll members 18 and 15** in the axial direction thereof and instantaneously lowering pressure in the compression chamber. Therefore, reduction of overload is quickly performed. Further, reduction of load at early stage from starting contributes less vibration and noise in that stage. Besides, durability of sliding surfaces is improved, and power loss is decreased.

When pressure in the compression chamber instantaneously rises abnormally, the thrust force acting on the orbiting scroll member 18 becomes larger than the urging force acting on the back of the orbiting scroll member 18. Consequently, the orbiting scroll member 18 moves in the axial direction thereof, and the disk-shaped plate **18*c* is detached from the end plate 15*b* of the fixed scroll member 15 with the back pressure chamber 39 and the suction chamber 17 held to be gas-tight from each other, so that seal of both scroll members 18 and 15** is broken in the axial direction thereof. Thereby, pressure in the compression is lowered, and compression load is reduced. Damage of the compressor or wear of the sliding surfaces is therefore prevented, thereby improving durability of the compressor.

If pressure in the compression chamber is not lowered in spite of breaking of the seal, the thrust bearing 20 moves backward against urge of the lubricating oil to reduce the gap 27 (FIG. 3) with the disk-shaped plate **18*c* put thereon. Thereby, the orbiting scroll member 18 moves further away from the end plate 15*b* of the fixed scroll member 15, to enlarge the gaps between both scroll members 18 and 15 in the axial direction thereof. As a result, pressure in the compression chamber is quickly lowered, thereby reducing the compression load and preventing damage of the compressor and wear of the sliding surfaces. Also, durability of the compressor is improved. When a certain large alien substances happens to be put in the gap between both scroll members 18 and 15, the orbiting scroll member 18 moves backward in the same way as mentioned above. The alien substances are then removed together with flow of compressed refrigerant gas. As a result, abnormal wear of both scroll members 18 and 15** is prevented to thereby eliminate leakage of refrigerant gas and declinatiohn of compression efficiency.

As shown in FIG. 4, the oldham ring 24 is of such a simple configuration that unevenness is formed on one surface thereof. Therefore, the oldham ring 24 is made by the most suitable manufacturing method among some methods, and warp of the arc-shaped portion 24*a* is minute. Further, it is easy to precisely cut the key portions 24*b*, and it is possible to lighten weight by thinning itself.

Since interval of a pair of straight portions 24*h* or a pair of straight portions 20*a* is sufficiently large and simple in configuration thereof, accuracy and rigidity of cutting tolls or punches of metal mold are improved, thereby making easy to cut or mold the straight portions. As a result, accuracy of the straight portions is high, and working cost thereof is lowered. Therefore, gaps between the thrust bearing 20 and the oldham ring 24 are minimized. Furthermore, change of inertia at the time when the oldham ring 24 changes direction of movement thereof is minimized, and backlash of the oldham ring 24, which is based on the gaps between the thrust bearing 20 and the oldham ring 24, are also minimized. Vibration applied to the thrust bearing 20, which is movable in the axial direction thereof, is thereby reduced. Since the disk-shaped plate 18*c* is held between the end plate 15*b* of the fixed scroll member 15 and the thrust bearing 20 with minute gaps, inclination of the orbiting scroll member 18 against the driving shaft 4 or jumping of the orbiting scroll member 18 in the axial direction thereof does not occur at normal change of compression load or at acceleration, deceleration or high speed driving, thereby presenting silent driving with minimum vibration.

When the orbiting scroll member 18 moves backward, periphery of the disk-shaped plate 18*c* is supported by the thrust bearing 20. Therefore, inclination of the disk-shaped plate 18*c* is minimized, and incongruity of axes of the orbiting scroll member 18 and the bearing 14 is prevented. Durability of the bearing 14 is thereby improved.

The oldham ring 24 reciprocates to follow orbiting motion of the orbiting scroll member 18, and thereby position of a center of gravity of the orbiting scroll member 18 is changed. However, since the oldham ring 24 of this embodiment is light-weight, change of the center of gravity becomes small and unbalance of the driving apparatus is reduced. Vibration of the compressor is thereby small even on high-speed running.

Areas of the straight portions 24*h* (FIG. 4) and 20*a* (FIG. 6) are sufficiently large to reduce wear thereof, and the back lash of the oldham ring 24 is held to be minimum. Therefore, any minute rotation of the obiting scroll member 18 does not occur, thereby eliminating change of gaps between both scroll members 18 and 15 in the circumferential direction and reducing leakage of compressed refrigerant gas. Since the straight portions 24*h* and 20*a* are sufficiently long, so that the respective spaces 77*a* and 77*b* in which lubricating oils are repeatedly pressurized are not communicated each other. Therefore, enforced oil-supply is sufficiently performed on low-speeding running.

The thrust bearing 20 of flat plate-shape serves both as the rotation-prevention means and the overload reduction means within the minimum occupation space therefor in the axial direction.

Since the relief concave 98 (FIG. 6) serves as an oil pool of lubricating oil, sliding surfaces of the thrust bearing 20 and the oldham ring 24 are sufficiently lubricated. Friction and wear are thereby minimized, and power loss and vibration are reduced. Furthermore, since the relief concave 98 serves as a damper, mechanical noise generated on the sliding surfaces of the thrust bearing 20 and the oldham ring 24 is reduced.

Figure 15:
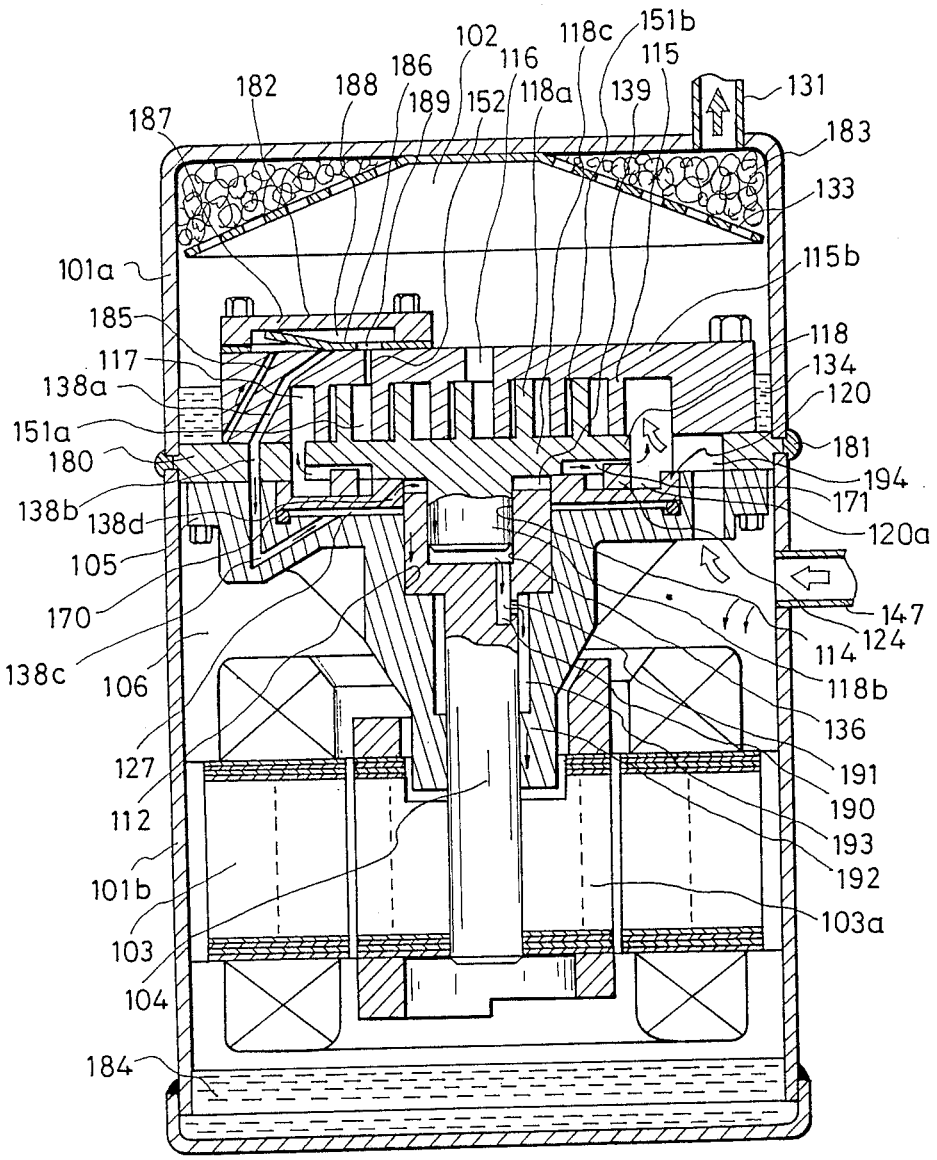
FIG. 15 is a cross-sectional view showing a scroll compressor of a second embodiment of the present invention.
Figure 16:
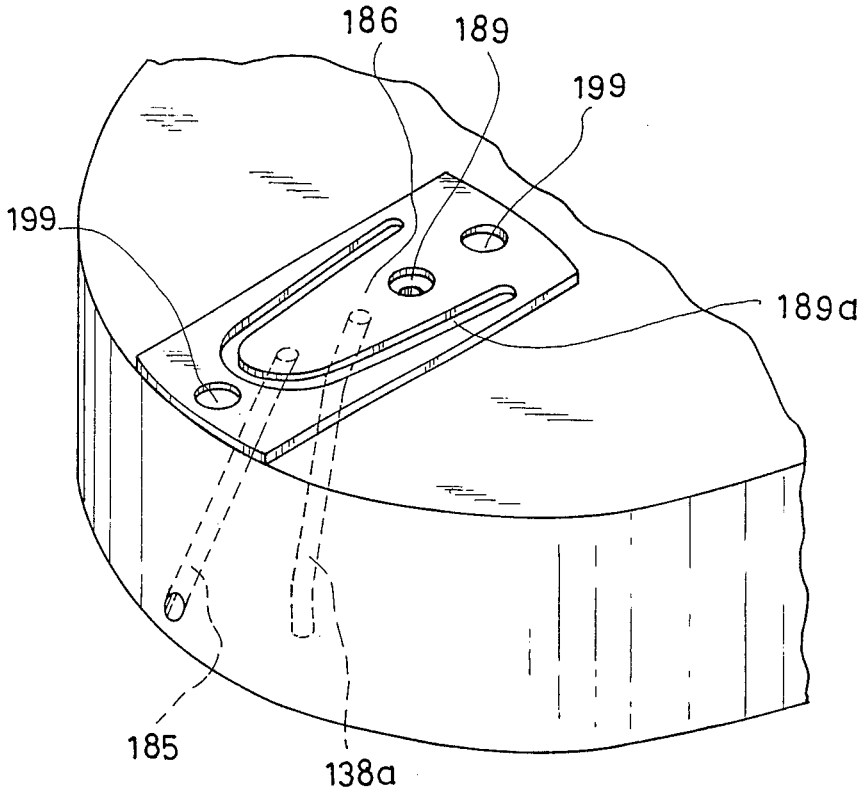
FIG. 16 is a perspective view showing a reed valve 186 etc.

Next, a second embodiment of the present invention is described. FIG. 15 is a cross-sectional view showing a scroll compressor of the second embodiment. FIG. 16 is a perspective view showing a part of a fixed scroll member 115 and a reed valve 18*b* provided thereon in FIG. 15. In FIG. 15, two enclosure cases 101*a* and 101*b* made of steel are welded with one ring-shaped bead 181, thereby to hermetically couple each other. A circumferential part of an intermediate plate 180 is also welded with the bead 181 together with the cases 101*a* and 101*b*. The intermediate plate 180 is made of soft steel, and a main frame 105 is secured thereon. A space enclosed by the cases 101*a* and 101*b* is separated into a delivery chamber 102 of upper side and a driving chamber 106 of lower side (low pressure side) by the intermediate plate 180.

A motor 103 is held by the main frame 105 and driven by an power supply (not shown) loaded with an inverter (not shown). An orbiting shaft 118*b* of an oribiting scroll member 108 is inserted into an eccentric hole 136 formed in upper end of a driving shaft 104 which is to be rotated by the motor 103. An oldham ring 124, which serves to prevent rotation of the orbiting scroll member 118, is engaged with a hole 120*a* of the thrust bearing 120 and a hole 171 of the orbiting scroll member 118. The thrust bearing 120 is movably only in the axial direction thereof by limiting action of a cottor (not shown). The fixed scroll member 115, which is engaged with the orbiting scroll member 118, is secured to the intermediate plate 180 by bolts, and a discharge port 116 if formed in an end plate 115*b* of the fixed scroll member 115. A lubrication control valve unit 182 of lead-valve type is fixed on an upper surface of the end plate 115*b*.

The thrust bearing 120 is always urged to push the orbiting scroll member 118 by elastic force of the rubber seal ring 170 and is limited to move upward (in FIG. 15) by touching the intermediate plate 180. At most upper position of the thrust bearing 120, gaps between the thrust bearing 120 and the orbiting scroll member 118 are selected to be minute (about 0.020 mm) so that the orbiting scroll member 118 is pushed to the fixed scroll member 115 and smoothly orbited thereon.

A bottom part of the delivery chamber 102 serves as an oil pool 134, and an umbrella-shaped punched metal 133 having a lot of small holes is fixed to the case 101*a*. Between the case 101*a* and the punched metal 133, a resin filter 183 of fine wire is stuffed. The delivery chamber 102 is communicated with the driving chamber 106 through a delivery pipe 131 provided on upper surface of the case 101*a*, an external refrigerant cycle (not shown) and a suction pipe 147 provided beside the case 101*b* in this order. A lower part of the driving chamber 106 serves as an oil pool 184. The lubrication control valve unit 182 comprises the reed valve 186 of thin steel and a cover 187. The read valve 186 is fixed on the end plate 115*b* together with the cover 187. A limiting passage is constituted by a valve space 188 between the cover 187 and the end plate 115*b*, a through-hole 189 of the reed valve 186 and a very narrow injection passage 152 formed in the end plate 115*b*. Second compression chambers 151*a* and 151*b* which are not communicated with the delivery chamber 102 nor the suction chamber 117, are communicated with the oil pool 134 through a first oil-supply passage including the above-mentioned limiting passage. The orbiting scroll member 118 comprises a disk-shaped plate 118*c* and an orbiting scroll wrap 118*a* formed on the disk-shaped plate 118*c*. The disk-shaped plate is put between the fixed scroll member 115 and the thrust bearing 120. A back pressure chamber 139 is formed among the disk-shaped plate 118*c*, the thrust bearing 120 and the driving shaft 104. An oil-supply passage, which branches off from the way of the first oil-supply passage, is constituted by a valve space 188, a U-shaped through-hole 189*a* (FIG. 16) of the reed valve 186, an oil passage 138*a* formed in the end plate 115*b*, a very narrow oil passage 138*b* formed in the intermediate plate 180, an oil passage 138*c* formed in the main frame 105, a gap 127 which is formed between the thrust bearing 120 and the main frame 105 and supported and sealed by the seal ring 170 therearound, and an oil passage 138*d* formed in the thrust bearing 120. The back pressure chamber 139 is thus communicated with the first oil-supply passage.

A limiting passage is constituted by a gap on a main bearing 112, a gap on an eccentric bearing 114, an oil hole 190 eccentrically formed in the driving shaft 104, a lateral hole 191, an oil groove 193 between a lower side bearing 192 formed in a lower part of the main frame 105 and the main bearing 112, and a gap on the lower side bearing 192. The back pressure chamber 139 is communicated with the driving chamber 106 through a first lubrication passage including the above-mentioned limiting passage.

The back pressure chamber 139 and the suction chamber 117 are communicated each other through a second lubrication passage formed by a gap between the thrust bearing 120 and the disk-shaped plate 118*c* and gaps on the oldham ring 124.

Next, operation of the scroll compressor of the second embodiment is described. When the driving shaft 104 is rotated by the motor 103, the orbiting scroll member 118 orbits around an axis of the driving shaft 104. Suction refrigerant gas flows into the driving chamber 106 through the suction pipe 147 from the refrigerating cycle connected to the compressor. At the driving chamber 106, some amount of lubricating oil contained in the refrigerant gas is separated from the refrigerant gas, and thereafter, the refrigerant gas is sucked into the suction chamber 117 through a suction passage 194. Between the orbiting scroll member 118 and the fixed scroll member 115, first, second and third compression chambers are formed in the same way as shown in FIG. 7. By orbiting motion of the orbiting scroll member 118, the refrigerant gas is taken into the first compression chamber (not shown). Further, the refrigerant gas is moved to the second compression chambers 151*a* and 151*b* and the third compression chambers (not shown) in this order, and the refrigerant gas is thereby compressed more and more. Finally, the refrigerant gas is delivered to the delivery chamber 102 through the discharge port 116.

At the time of passing through the punched metal 133 and the filter 183, some amount of lubricating oil contained in the refrigerant gas is separated from the refrigerant gas by weight itself and attachment on the punched metal 133 or the filter 183, and the separated lubricating oil is collected into the oil pool 134. The other or lubricating oil is delivered to the external refrigerating cycle together with delivery refrigerant gas through a delivery pipe 131 and returns to the compressor together with suction refrigerant gas through a suction pipe 147.

For a short while after cold-starting of the compressor, pressure in the delivery chamber 102 is lower than pressure in the second compression chambers 151*a* and 151*b*. Therefore, lubricating oil in the oil pool 134 is not supplied into the first oil-supply passage. Further, backflow of refrigerant gas under compression from the second compression chambers 151*a* and 151*b* to the oil pool 134 is prohibited owing to action of the reed valve 186, and flowing-in to the gap 127 and the back pressure chamber 139 is also prohibited. Each sliding surface is lubricated only by lubricating oil remaining thereon.

Since pressure in the back pressure chamber 139 and the gap 127 is low at early stage from starting of the compressor, the thrust bearing 120 slightly moves backward (downward in FIG. 15) to thereby reduce compression load at that stage.

After a short time from cold-starting of the compressor, pressure in the delivery chamber 102 becomes larger than that in the second compression chambers 151*a* and 151*b*, and lubricating oil in the oil pool 134 flows into the first oil-supply passage by raising the reed valve 186. On the way of the first oil-supply passage, pressure of lubricating oil is gradually lowered, and the lubricating oil is supplied to the second compression chambers 151*a* and 151*b* by differential pressure. Besides, pressure of the lubricating oil is gradually reduced by passing through the oil passage 138*a*, 138*b* and 138*c* in this order. Thereby, pressure of the lubricating oil is finally adjusted into medium pressure of delivery pressure and suction pressure, and the lubricating oil of medium pressure is supplied to the gap 127 and the back pressure chamber 139 by differential pressure.

The lubricating oil, which is supplied to the second compression chambers 151*a* and 151*b* by the differential pressure, joins with lubricating oil, which has flowed into the compression chamber together with suction refrigerant gas, and forms oil film to seal minute gaps between both scroll members 115 and 118, thereby preventing leakage of refrigerant gas. While forming the oil film, the lubrication oil is delivered into the delivery chamber 102 together with the compressed refrigerant gas.

The lubricating oil of medium pressure, which is supplied to the gap 127 and the back presure compartment 139, gives back pressure to push the orbiting scroll member 118 upward in FIG. 15, thereby reducing thrust force acting downward on the orbiting scroll member 118 which is likely to detach from the fixed scroll member 115 by pressure in the compression chamber. Consequently, thrust force acting on the thrust bearing 120 by the orbiting scroll member 118 is reduced, and the thrust bearing 120 is pushed to touch the intermediate plate 180. The orbiting scroll member 118 is put between the fixed scroll member 115 and the thrust bearing 120 with minute gaps, thereby enabling smooth orbiting motion of the orbiting scroll member 118. Since back pressure in the back pressure chamber 139 is adjusted so as not to allow the orbiting scroll member 118 to detach from the thrust bearing 120, the back pressure chamber 139 and the suction chamber 117 are gas-tightly separated from each other. Pressure of the lubricating oil is reduced by passing through very narrow gaps between the orbiting scroll member 118 and the thrust bearing 120. Further, the lubricating oil lubricates sliding surfaces of the oldham ring 124 and gets mixed in the suction refrigerant gas. Subsequently, the lubricating oil passes through the first lubrication passage, a gap between the orbiting shaft 118*b* and the eccentric bearing 114, a space 136, the oil hole 190 and the lateral hole 191 in this order, thereby to form one oil-supply passage. The lubricating oil is thus sent to the oil groove 193. Also, lubricating oil flows into the oil groove 193 through a gap on the main bearing 112. Further, the lubricating oil in the oil groove 193 flows into the driving chamber 106 through minute gaps on the lower side bearing 193. Passing through these gaps, pressure of the lubricating oil is reduced finally to a low pressure. Some amount of the lubricating oil in the driving chamber 106 gets mixed with the suction refrigerant gas and flows into the compression chamber again. The other lubricating oil is collected in the oil pool 184. Lubricating oil in the oil pool 184 is cooled by radiation via the case 101*b*. When oil level of the lubricating oil in the oil pool 184 becomes higher than the predetermined height, a rotor 103*a* of the motor 103 splashes the lubricating oil in the driving chamber 106. The lubricating oil is thereby mixed with the suction refrigerant gas, and the refrigerant gas including lubricating oil flow into the compression chamber again. Finally, the lubricating oil in the refrigerant gas is collected into the oil pool 134.

When instantaneous liquid-compression occurs at early stage from cold-starting or steady running state, pressure in the second compression chambers 151*a* and 151*b* abnormally rises. Even at that time, owing to action of the reed valve 186 as a check valve, back flow of compressed refrigerant gas from the compression chambers 151*a* and 151*b* to the oil pool 134 is prevented. Also, back flow to the gap 127 or the back pressure chamber 139 is prevented, and the back pressure does not rise. The thrust bearing 120 is therefore allowed to move backward, thereby preventing abnormal continuous pressure-rise.

After stoppage of the compressor, the suction passage 194 is closed by a check valve (not shown) provided therein. Pressure in a route from the delivery chamber 102 to the suction chamber 117 becomes equal to pressure in the delivery chamber 102 by communicating each other through gaps between both scroll members 115 and 118, and an upper end aperture of an oil passage 185 is closed by the reed valve 186. The lubricating oil in the oil pool 134 just after stoppage of the compressor is not supplied to the second compression chambers 151*a* and 151*b* and the back pressure chamber 139, and the lubricating oil in the back pressure chamber 139 gradually returns to the driving chamber 106 through the first oil-supply passage until differential pressure is lowered below the predetermined value.

In the above-mentioned embodiment, though pressure of the lubricating oil in the oil pool 134 is reduced into medium pressure to supply lubricating oil of medium pressure to the gap 127 and the back pressure chamber 139, when another construction of the thrust bearing and the back pressure chamber is adopted, reduction of the pressure of lubricating oil may be not necessary.

Figure 17:
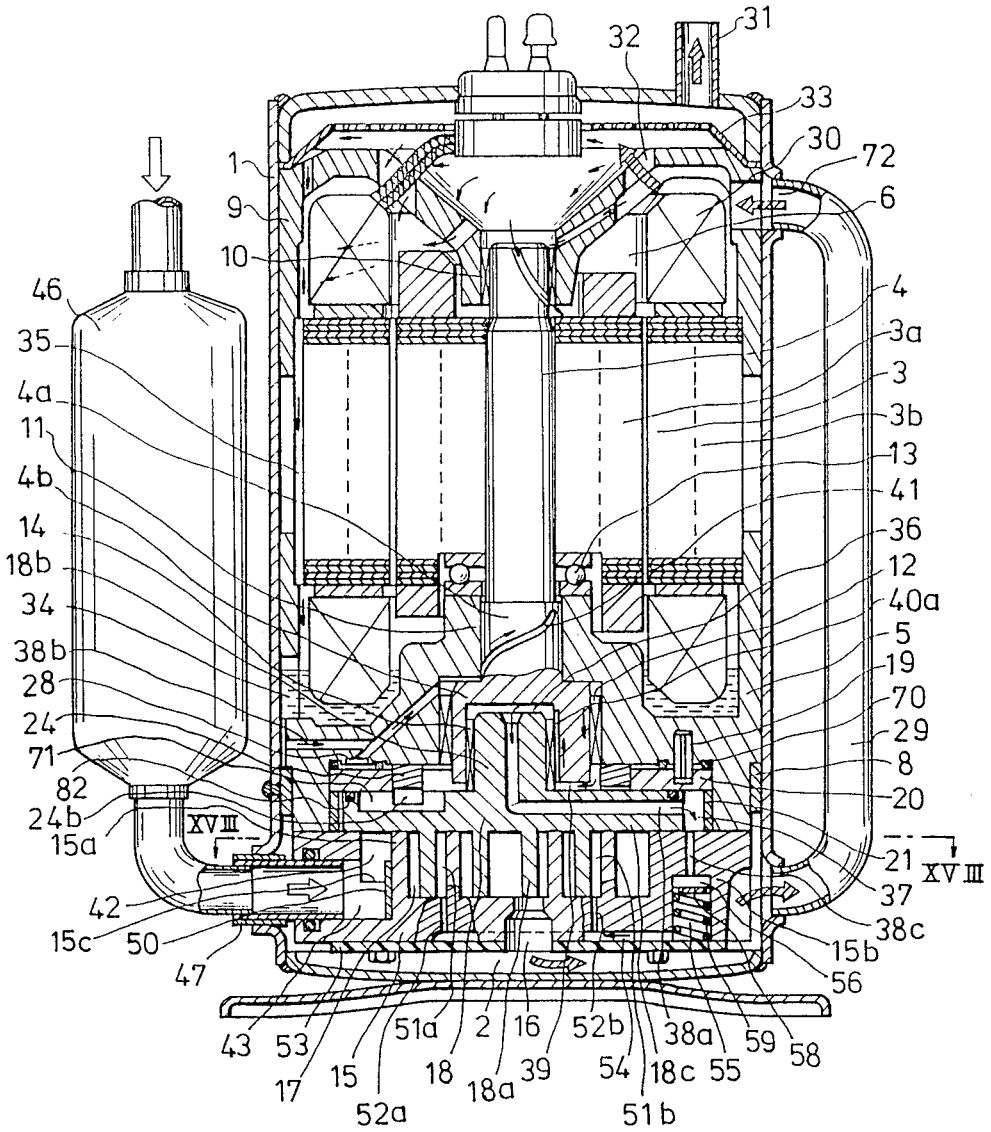
FIG. 17 is a cross-sectional view showing a scroll compressor of a third embodiment of the present invention.
Figure 18:
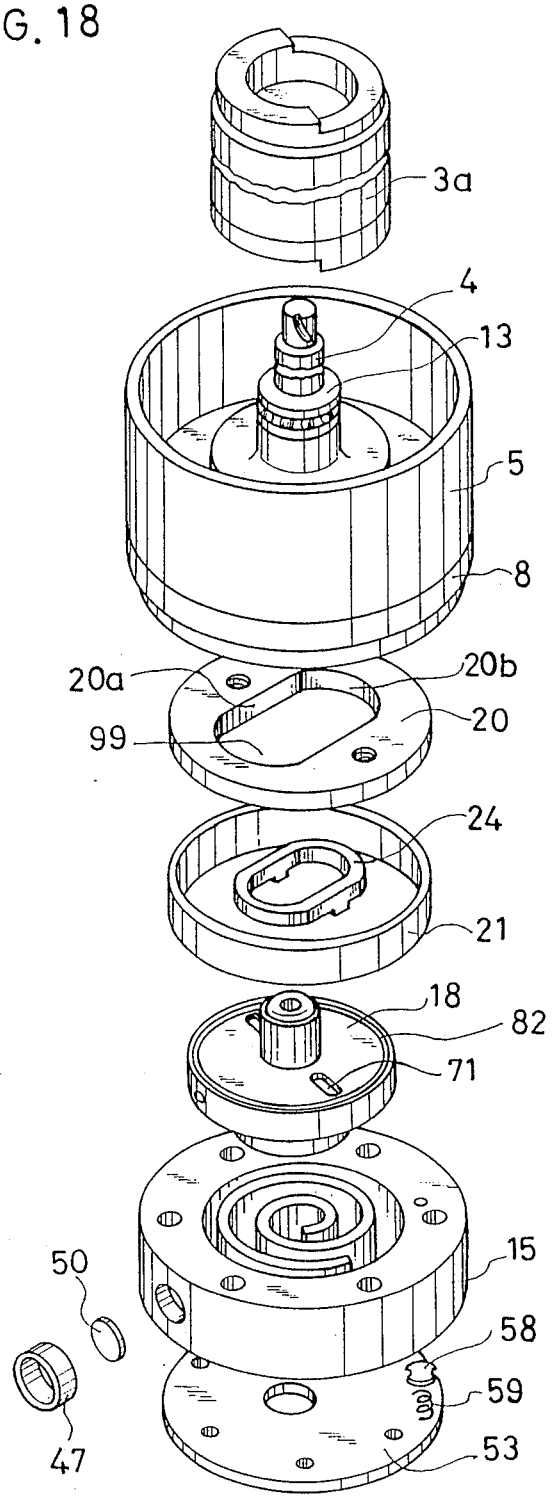
FIG. 18 is a perspective view showing major parts of a scroll compressor shown in FIG. 17.
Figure 19:
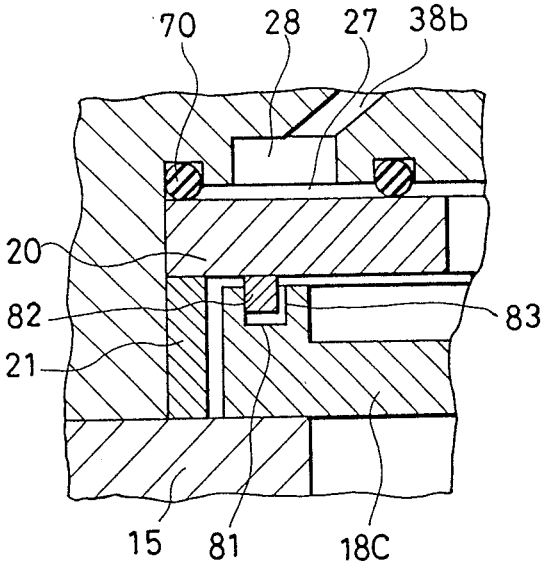
FIG. 19 is a partially enlarged cross-sectional view showing only a thrust bearing 20 and peripheral parts thereof in FIG. 1.
Figure 20:
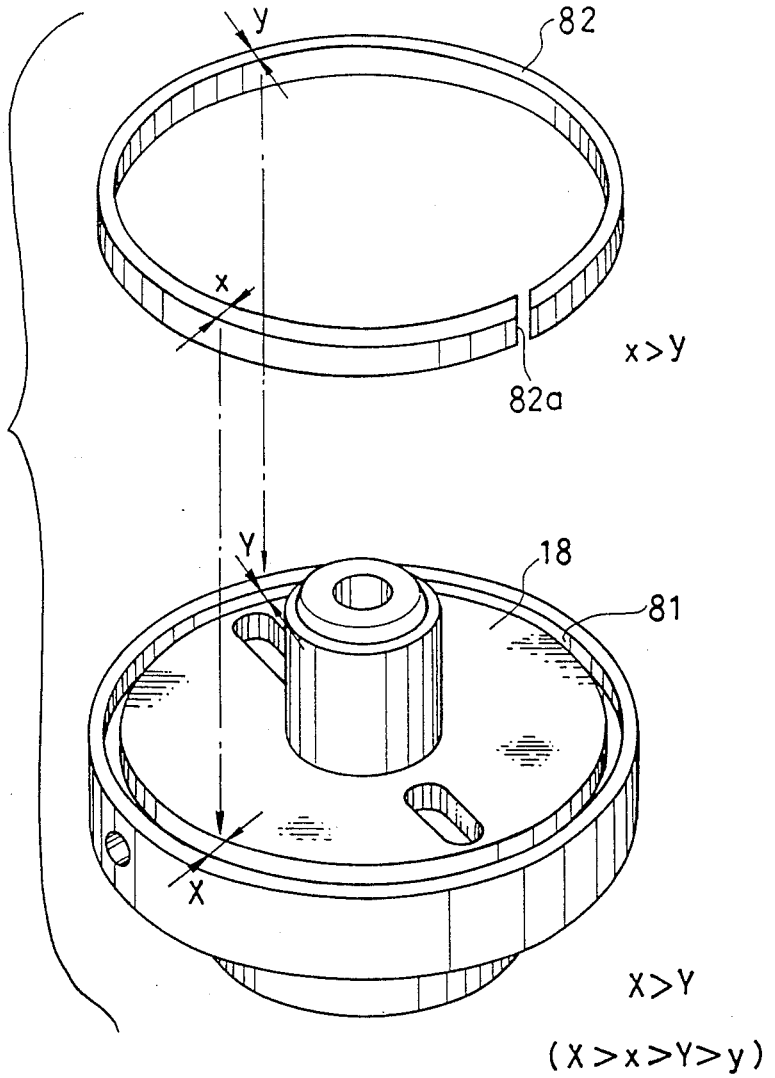
FIG. 20 is a perspective view showing an annular ring 82 in FIG. 17.

Next, a third embodiment of the present invention is described. FIG. 17 is a cross-sectional view showing a scroll compressor of the third embodiment which is similar to the first embodiment. Corresponding parts to the first embodiment are shown by the same numerals and marks, and the description thereon made in the first embodiment is similarly applied. FIG. 18 is a perspective view showing major parts of the scroll compressor shown in FIG. 17, and FIG. 19 is a partially enlarged cross-sectional view showing peripheries of the thrust bearing 20. FIG. 20 is a perspective view showing an annular ring 82.

In FIG. 17, movement of thrust bearing 20 is restricted by a pair of split cotters 19 fixed to the main frame 5 only in the axial direction thereof. A spacer 21 is provided between the thrust bearing 20 and the end plate 15*b* of the fixed scroll member 15, and length of the spacer 21 in the axial direction is about 0.015–0.020 mm larger than thickness of the disk-shaped plate 18*c* in the axial direction in order to allow forming of an oil film for sealing on the surfaces of the disk-shaped plate 18.

As shown in FIG. 17 and FIG. 19, there is the gap 27 of about 0.05 mm between the main frame 5 and the thrust bearing 20. The circular hole 28 opened to the gap 27 is formed in the main frame 5, and the rubber seal ring 70 is provided between the main frame 5 and the thrust bearing 20.

As shown in FIG. 19, an annular groove 81 is formed on the most peripheral part of the disk-shaped plate 18*c* of the orbiting scroll member 18. An annular ring 82, which is made of elastic sintered alloy, is mounted in the annular groove 81 with minute gaps therebetween. The maximum length of these gaps in the axial direction of the orbiting scroll member 18 is more than 0.025 mm so that oil film can be formed. As shown in FIG. 20, the annular ring 82 has a cut-off portion which opens in its free state. A pair of opposing cut ends 82*a* is formed in a slanted direction with respect to the radial direction. A gap between the opposing cut ends 82*a* is determined so that an outer circumferential surface of the ring 82 tightly touches an outer circumferential surface of the annular groove 81 with minute gaps by elastic force thereof at the time when the ring 82 is mounted in the groove 81. Both widths of the annular groove 81 and the annular ring 82 are not uniform over the whole circumference thereof, so that the annular ring 82 cannot rotate within the annular groove 81 (see FIG. 20).

Next, operation of the above-mentioned scroll compressor of the third embodiment is described. As aforementioned with regard to the first embodiment, at an early stage after starting of the compressor from the balanced state of pressure in the compressor, the orbiting scroll member 18 receives thrust force in an opposite direction (upward in FIG. 17) to the discharge port 16 by pressure of pressurized refrigerant in the compression chamber. However, since back pressure, which is to be used to push the orbiting scroll member 18 downward, has not been generated yet, the orbiting scroll member 18 moves upward away from the fixed scroll member 15 and is supported by the thrust bearing 20. At that time, gaps of about 0.015–0.020 mm are formed between both scroll members 15 and 18 in the axial direction thereof. Some amount of the refrigerant gas flows into an adjacent low-pressure side of the compression chamber through the gaps, thereby temporarily lowering pressure in the compression chamber. Compression load at the early stage from starting is thus reduced.

Initial supporting force by which the orbiting scroll member 18 is supported on the thrust bearing 20 is given by elastic force of the seal ring 70 and auxiliary spring means (not shown, for instance the leaf spring 2023 in FIG. 30).

The annular ring 82 orbits to follow the orbiting scroll member 18 and rakes up lubricating oil on a contacting surface of the thrust bearing 20 with the disk-shaped plate 18*c*, thereby collecting lubricating oil around the annular groove 81. The gaps between the annular groove 81 and the annular ring 82 and the gaps between the annular ring 82 and the thrust bearing 20 are sealed by the collected lubricating oil. Substantial gap between both sliding surfaces of the end plate 15*b* and the disk-shaped plate 18*c* is made to be minute owing to the fact that oil film is formed between the disk-shaped plate 18*c* and the thrust bearing 20. Inclination and jumping of the orbiting scroll member 18 are prevented by the oil film which serves as a shock absorber, thereby reducing vibration and noise. Consequently, lubricating oil and refrigerant gas dissolved therein do not flow into the suction chamber 17 from the back pressure chamber 39. Thereafter, when pressure in the back pressure chamber 39 becomes high through the same way as that of the first embodiment, the disk-shaped plate 18*c* is urged to push the end plate 15*b* of the fixed scroll member 15 by the back pressure, and thereby gaps between both scroll members 15 and 18 in the axial direction are minimized to gas-tightly close the compression chamber. Suction refrigerant gas is thus compressed efficiently, and stable running state is continued.

When liquid-compression occurs in the compression chamber thereby resulting in abnormal temporary rise of pressure, thrust force acting on the orbiting scroll member 18 becomes larger than pushing force acting on a back surface of the orbiting scroll member 18. As a result, the orbiting scroll member 18 moves in the axial direction (upward in FIG. 17) thereof, and thereby the disk-shaped plate 18*c* is detached from the end plate 15*b* of the fixed scroll member 15 and supported by the thrust bearing 20. At the same time, sealing of the compression chamber is broken off, thereby reducing pressure in the compression chamber and compression load.

At the early stage after starting of the compressor, the orbiting scroll member 18 is supported by the elastic force of the seal ring 70 or the spring means via the thrust bearing 20. Further, the orbiting scroll member 18 receives pushing force of medium pressure by lubricating oil which is supplied to the back pressure chamber 39 in the steady running state, and thereby the disk-shaped plate 18*c* is pushed on the end plate 15*b* with the oil film formed therebetween. The space 37 is thus gas-tightly separated from the suction chamber 17. The lubricating oil in the back pressure chamber 39 also enters gaps (about 0.015–0.020 mm) between sliding surfaces of the thrust bearing 20 and the disk-shaped plate 18*c*, and this lubricating oil is gathered to both sides (inner and outer circumferential sides) of the annular ring 82 by its gathering action, thereby sealing the minute gaps between the annular ring 82 and the annular groove 81 and the gaps (about 0.015–0.020 mm) between the disk-shaped plate 18*c* and the thrust bearing 20.

By orbiting motion of itself, the annular ring 82 intends to rotate in the annular grooves 82. However, owing to such configurations of the annular ring 82 and the groove 81 that some width of the groove 81 is smaller than that of the ring 81 and that the outer circumferential surface of the ring 81 tightly touches that of the groove 82, movement of the ring in both radial and circumferential direction of the groove 81 is prohibited. Therefore, wear of contacting surfaces of the annular ring 82 and the groove 81 and mechanical noise caused by contact of the ring 82 with the groove 81 are prevented, and oil film which seals the gaps between the ring 82 and the groove 81 is stably formed. Thereby, the compressor is stably and silently driven. Further, since the cut ends 82*a* of the ring 82 are in contact with each other in the groove 81, leakage of lubricating oil through the cut-off, which results in declination of compression-efficiency, is prevented.

Since operation of other parts is similar to that of the first embodiment, details therefor will be omitted.

Although the thrust bearing 20 is allowed to move backward as large as 0.05 mm to thereby enlarge gaps between the orbiting scroll member 18 and the fixed scroll member 15, such a large movement is not always necessary. Necessary backward-movement of the thrust bearing 20 is determined in response to degree of overload. Especially, in such a small displacement compressor that high-speed running is not required, it is sufficient to enlarge the gap between both scroll members 18 and 15 in the axial direction up to about 0.020 mm to thereby instantaneously lower overload pressure in the compression chamber even at the time of abnormal liquid-compression. According to compression load of the compressor, it will be possible to eliminate the gap 27 between the thrust bearing 20 and the main frame 5 and elastic force applied to the thrust bearing 20.

Figure 20A:
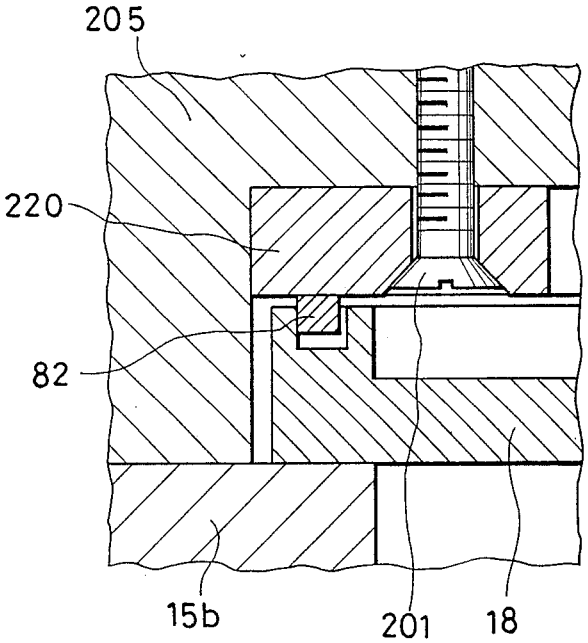
FIG. 20*a* is a cross-sectional view showing a still other embodiment about a thrust bearing 220 and peripheral parts thereof.
Figure 21:
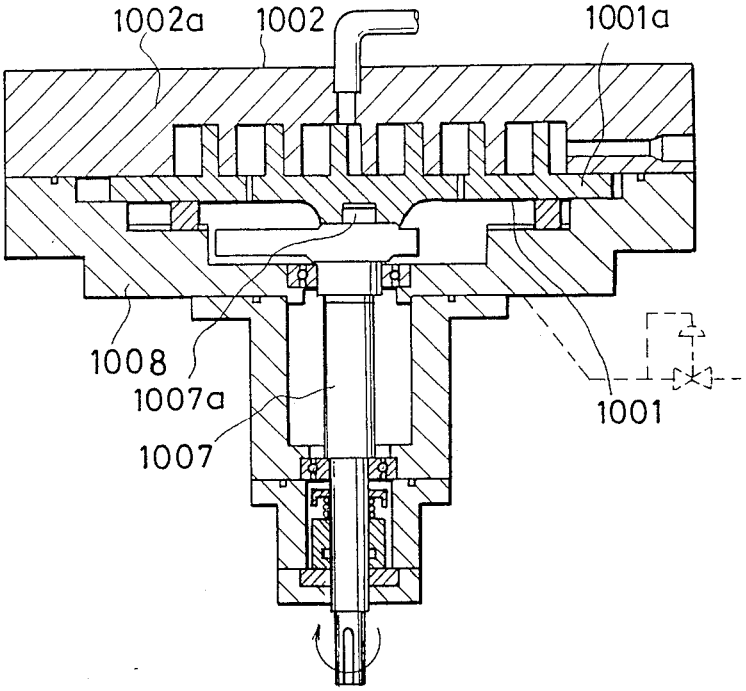
FIG. 21 (Prior Art)
FIG. 21 is the cross-sectional view showing the conventional scroll compressor.
Figure 22:
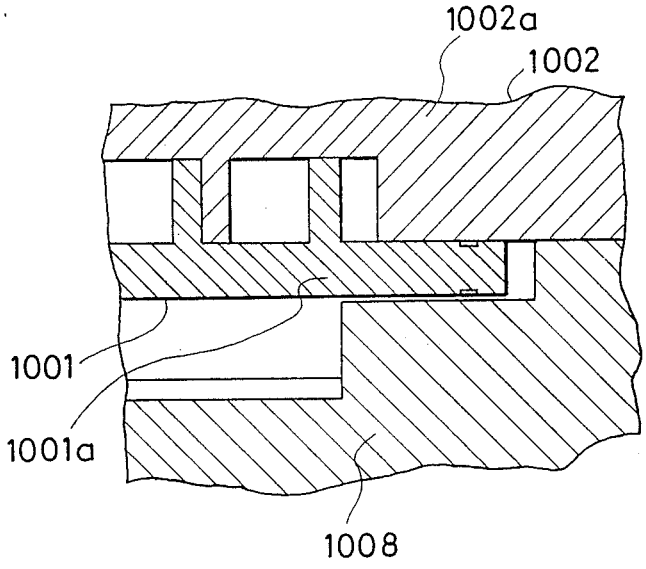
FIG. 22 (Prior Art)
FIG. 22 is the partially enlarged view of FIG. 21.
Figure 23:
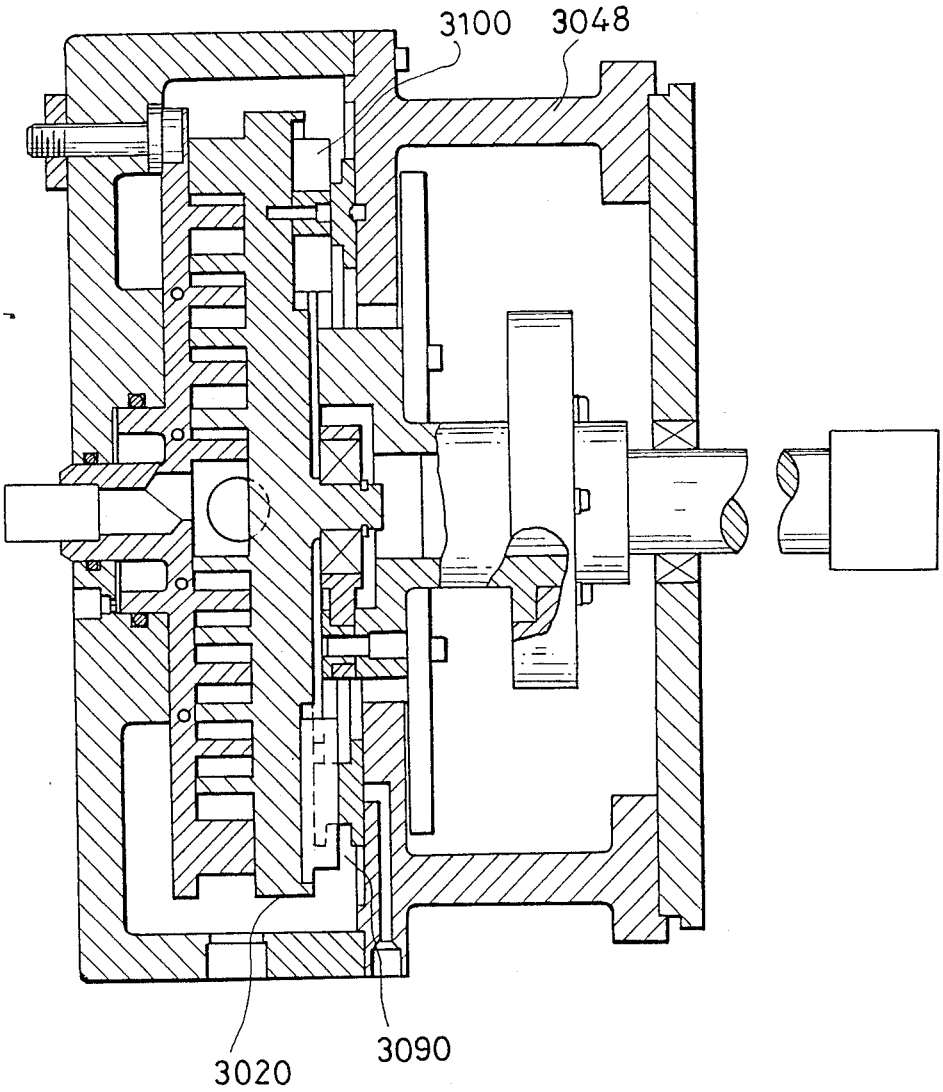
FIG. 23 (Prior Art)
FIG. 23 is the cross-sectional view showing another conventional scroll compressor.
Figure 24:
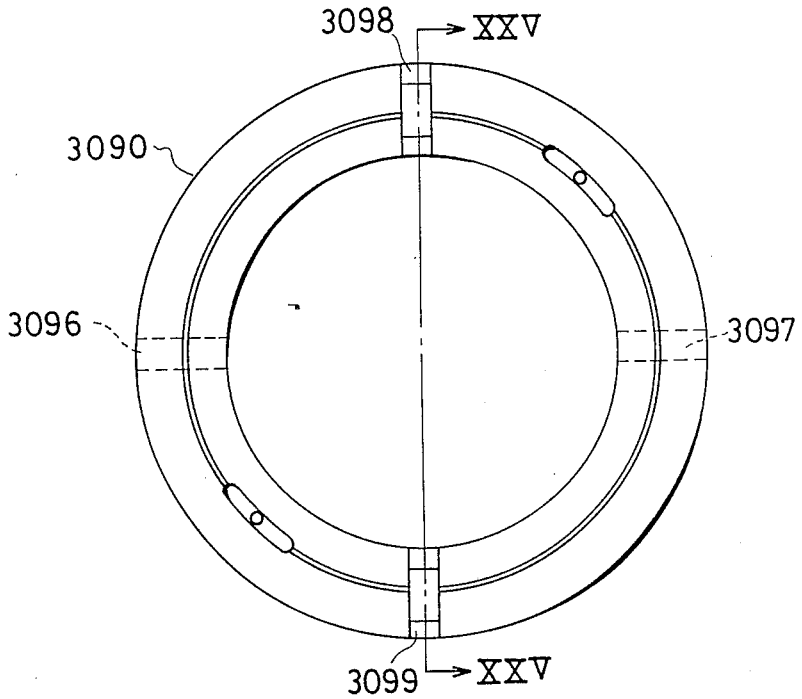
FIG. 24 (Prior Art)
FIG. 24 is the plane view showing the coupling member 3090 in FIG. 23.
Figure 25:
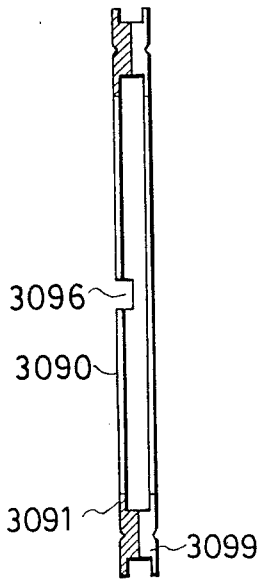
FIG. 25 (Prior Art)
FIG. 25 is the cross-sectional view taken on line XXV—XXV in FIG. 24.
Figure 26:
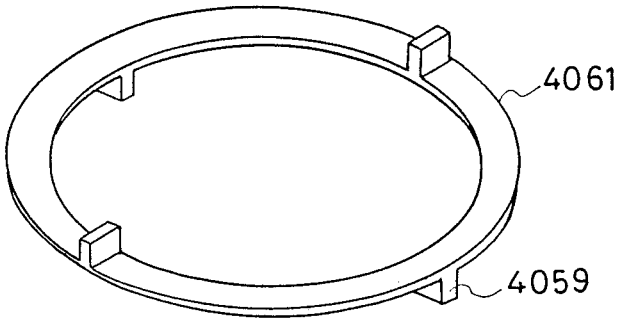
FIG. 26 (Prior Art)
FIG. 26 is the perspective view showing still other conventional annular ring.
Figure 27:
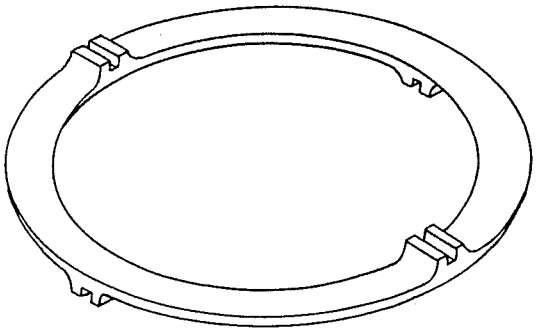
FIG. 27 (Prior Art)
FIG. 27 is the perspective view showing still other conventional annular ring.
Figure 28:
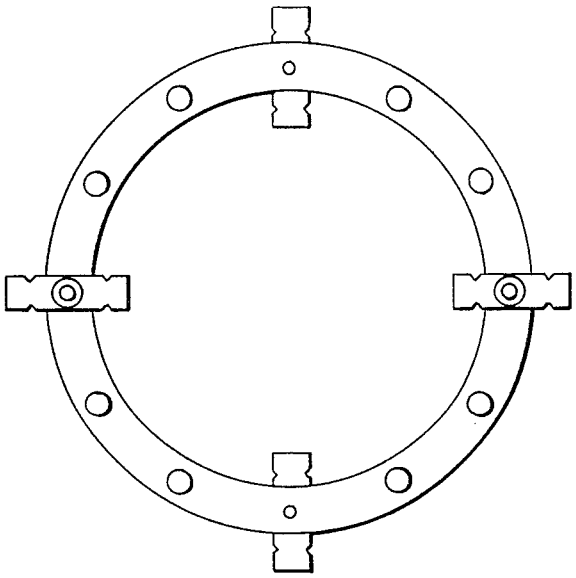
FIG. 28 (Prior Art)
FIG. 28 is the plane view showing still other conventional ring.
Figure 29:
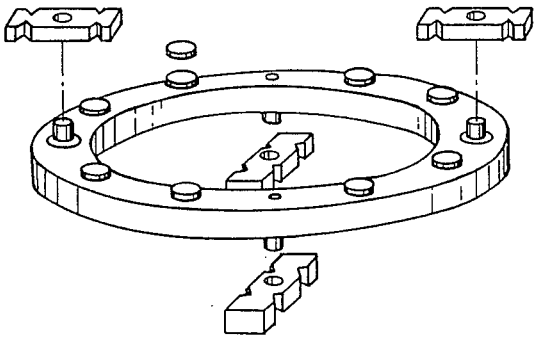
FIG. 29 (Prior Art)
FIG. 29 is the perspective view of the ring in FIG. 28.

FIG. 20*a* is a partially enlarged cross-sectional view similar to FIG. 19, showing a still other embodiment about a thrust bearing 220 and its peripheral parts. The thrust bearing 220 is secured to a main frame 205 by a screw 201. According to this construction, minute movement of the thrust bearing 220 in the circumferential direction does not occur. Thereby, movement of the oldham ring 24 and the orbiting scroll member 18 in the circumferential direction is reduced, and vibration and noise generated from engaging portions between the orbiting scroll member 18 and the oldham ring 24 are minimized. Also, the thrust bearing 220 can be integrally formed with the main frame 205.

In the above-mentioned three embodiments, the scroll compressor can be similarly applied to compress not only refrigerant gas but also other gasses such as oxygen, nitrogen or helium.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A scroll compressor comprising:

a stationary member;

a first scroll member held by said stationary member;

a second scroll member which is orbitably held from said stationary member and to be engaged with said first scroll member, to form compression chambers;

driving means which is held by said stationary member and makes orbiting motion to drive said second scroll member;

supporting means which is movably held and urged from said stationary member to support thrust force of said second scroll member against said first scroll member within a predetermined stroke in an axial direction of said scroll members, the smallest gap between said supporting means and said first scroll member being larger than thickness of a part of said second scroll member put therebetween; and rotation-prevention means which is movably held by said supporting means and engaged with said second scroll member to prevent said second scroll member from rotating.

2. A scroll compressor in accordance with claim 1, wherein said first scroll member is fixed to said stationary member.

3. A scroll compressor in accordance with claim 2, wherein said supporting means is always urged to move toward said second scroll member by utilizing pressure of compressed fluid.

4. A scroll compressor in accordance with claim 3, wherein a back pressure chamber is formed on a disk-shaped plate of said second scroll member, and said back pressure chamber is communicated with a delivery chamber.

5. A scroll compressor in accordance with claim 3, wherein a back pressure chamber is formed on a diskshaped plate of said second scroll member, and said back pressure chamber is communicated with said compression chambers.

6. A scroll compressor in accordance with claim 3, 4 or 5, wherein said supporting means is preliminary urged by elastic force.

7. A scroll compressor in accordance with claim 5, further comprising a check valve which is provided on the way from said back pressure chamber to said compression chambers and allows fluid to flow only from said back pressure chamber to said compression chambers.

8. A scroll compressor in accordance with claim 3, wherein said second scroll member has an annular groove and an annular ring mounted therein, a gap between said annular groove and said annular ring in the axial direction being larger than the maximum gap between said second scroll member and said supporting means.

9. A scroll compressor in accordance with claim 8, wherein widths of said annular groove and said annular ring are not uniform over whole circumference thereof.

10. A scroll compressor in accordance with claim 8 or 9, wherein said annular ring has elasticity to radially open outward, and outer circumference thereof tightly touches an outer circumferential surface of said groove.

11. A scroll compressor in accordance with claim 8 or 9, wherein said annular ring has a cut-off portion therein, a pair of opposing cut ends being in contact with each other in said annular groove.

12. A scroll compressor in accordance with claim 3, wherein said rotation-prevention means is of ring-shaped and disposed between a disk-shaped plate of said second scroll member and said supporting means, said rotation-prevention means comprising a pair of projections for slidably engaging with a pair of holes formed in said disk-shaped plate and a pair of parallel opposing straight portions for slidably engaging with a pair of parallel opposing straight portions formed in said supporting means.

13. A scroll compressor in accordance with claim 3, wherein said rotation-prevention means includes an oldham ring that makes pump action by reciprocating in said supporting means.

* * * * *